US009413090B2

(12) United States Patent
Nagamine

(10) Patent No.: US 9,413,090 B2
(45) Date of Patent: Aug. 9, 2016

(54) FEMALE CONNECTOR AND CARD EDGE CONNECTOR

(71) Applicant: J.S.T. Mfg. Co., Ltd., Osaka-shi, Osaka (JP)

(72) Inventor: Akira Nagamine, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 13/899,707

(22) Filed: May 22, 2013

(65) Prior Publication Data

US 2013/0316586 A1 Nov. 28, 2013

(30) Foreign Application Priority Data

May 25, 2012 (JP) ..... 2012-119859
Mar. 1, 2013 (JP) ..... 2013-040570

(51) Int. Cl.
*H01R 24/00* (2011.01)
*H01R 12/72* (2011.01)
(Continued)

(52) U.S. Cl.
CPC ..... *H01R 12/721* (2013.01); *H01R 13/4223* (2013.01); *H01R 13/64* (2013.01); *H01R 12/75* (2013.01); *H01R 13/11* (2013.01)

(58) Field of Classification Search
CPC ..... H01R 12/721; H01R 12/75; H01R 13/11; H01R 13/4223; H01R 12/73; H01R 12/716; H01R 13/64
USPC ..... 439/630, 636, 637, 677, 680, 595, 633
See application file for complete search history.

(56) References Cited

U.S. PATENT DOCUMENTS 2,858,515 A * 10/1958 Thunander ..... H01R 13/26 174/138 R
4,357,066 A * 11/1982 Cairns ..... H01R 12/721 439/595

(Continued)

FOREIGN PATENT DOCUMENTS

CN 1362760 A 8/2002
JP H09-092370 A 4/1997

(Continued)

OTHER PUBLICATIONS

Office Action dispatched on Feb. 19, 2016 from the Chinese Patent Office regarding the corresponding Chinese patent application No. 20130178069.9.

*Primary Examiner* — Neil Abrams
*Assistant Examiner* — Travis Chambers
(74) *Attorney, Agent, or Firm* — Kratz, Quintos & Hanson, LLP

(57) ABSTRACT

A female connector connected with a card member includes a contact and a housing. The contact includes a connecting part connected to a card edge terminal on one side and a wire mounting part integrally formed with the connecting part on the other side. The housing has a flat opening to which the card edge part is inserted on one side and an inserting part through which the wire is inserted on the other side. The housing has inside an interior space communicating with the flat opening and accommodates the card edge part, and includes contact accommodating parts oppositely provided with the interior space interposed therebetween. The interior space of the housing has on at least one spot a rib connecting one side and the other side of the contact accommodating part. This can prevent reduction in contact pressure between the contact and the card edge terminal.

20 Claims, 16 Drawing Sheets

(51) Int. Cl.

| | |
|---|---|
| ***H01R 13/64*** | (2006.01) |
| ***H01R 13/422*** | (2006.01) |
| *H01R 12/75* | (2011.01) |
| *H01R 13/11* | (2006.01) |

(56) References Cited

U.S. PATENT DOCUMENTS 4,695,112 A * 9/1987 Maston ..... H01R 12/79 439/328
5,238,411 A * 8/1993 Jinno ..... H01R 12/721 439/59
5,573,415 A * 11/1996 Fujitani ..... H01R 12/87 439/260
5,775,950 A * 7/1998 Tsuji ..... 439/637
6,132,224 A * 10/2000 Murakami ..... H05K 1/118 439/260
6,220,881 B1 * 4/2001 Murakami ..... H01R 12/721 439/262
6,394,850 B1 * 5/2002 Oliphant ..... H01R 24/64 439/354
6,443,766 B2 * 9/2002 Ichio et al. ..... 439/587
6,494,781 B2 * 12/2002 Fujita ..... H01R 12/721 439/260
6,547,577 B2 4/2003 Fujita et al.
6,679,739 B2 * 1/2004 Fujita ..... 439/862
6,773,278 B2 * 8/2004 Valasek, Jr. ..... H01R 13/62933 439/157
8,876,561 B2 * 11/2014 Endo ..... H01R 13/40 439/752
9,281,592 B2 * 3/2016 Nagamine ..... H01R 12/721
2009/0280691 A1 * 11/2009 Liu ..... H01R 13/6658 439/629
2011/0021080 A1 * 1/2011 Kamiya et al. ..... 439/637
2011/0104952 A1 * 5/2011 Teh ..... 439/633
2015/0340784 A1 * 11/2015 Moriyasu ..... H01R 12/721 439/630

FOREIGN PATENT DOCUMENTS

JP 2000-3759 1/2000
JP 2008-98063 A1 4/2008

* cited by examiner 46
50
55
11

11
46
50

11
46
52
52
46
50

51
13
11
50

11
50
46

50
46
11

FEMALE CONNECTOR AND CARD EDGE CONNECTOR

TECHNICAL FIELD

The present invention relates to a female connector connected to a card member in which card edge terminals are formed on a substrate, and a card edge connector. Specifically, the present invention relates to a female connector and a card edge connector in which contact pressure between the card member and a contact accommodated in the female connector is prevented from being reduced by preventing deformation of an opening of a housing included in the female connector, the opening through which the card member is inserted, and by providing a configuration for fixing the contact accommodated in the housing of the female connector to the housing.

BACKGROUND ART

In the related art, a card edge substrate and the like is known in which a terminal is formed at an end of the substrate to directly connect the substrate and a connector, whereby the substrate on which an electronic circuit and the like are printed is connected to electronic equipment and the like. A card edge connector, for example, is also known in which the above-described card edge substrate and a counterpart female connector are combined. In a female connector used in such a card edge connector, an opening to which the card edge substrate and the like are connected is formed to have a width corresponding to the width of the substrate.

For example, JP-A-2000-003759 discloses an invention of a connection structure of a card edge connector. In the description, the card edge connector includes a connector housing and a terminal fitting, the card edge connector is connected with a printed-circuit board, and the connector housing has at its front face an insertion space that opens in a horizontal slit shape and has a plurality of cavities that open at a ceiling surface of the insertion space.

However, with an insertion space that opens in a horizontal slit shape and is connected to a wide printed-circuit board formed in the card edge connector, opening deformation may occur from the opening to the insertion space. Such a deformation may result in reduction in the contact pressure between the terminal fitting and the printed-circuit board. Such a deformation is substantial when the card edge connector is in a high-temperature state.

Therefore, JP-A-2008-098063 discloses a card edge connector intended to prevent opening deformation. The card edge connector disclosed in JP-A-2008-098063 includes: a connector housing having a substrate insertion space to which an end of the substrate is inserted and that is mounted so as to sandwich the end of the substrate with both surfaces of the substrate; a plurality of terminal fittings arranged in the connector housing so as to face both surfaces of the substrate and having a contacting part that elastically contacts with a conducting path of the substrate; and an opening prevention member mounted to a position corresponding to the terminal fitting around an outer periphery of the connector housing.

In the card edge connector disclosed in JP-A-2008-098063 with such a configuration, the conducting path of the substrate and the contacting part of the terminal fitting elastically contact with each other when the substrate enters the substrate insertion space, and the terminal fitting receives force in a direction away from both surfaces of the substrate. The opening prevention member prevents opening deformation of the connector housing in a direction away from both surfaces of the substrate via the terminal fitting, so that the contact pressure between the contacting part and the conducting path can be secured.

In the card edge connector, a plurality of contact terminals are provided in the housing included in the card edge connector. These contact terminals are fixed in the housing so as not to move in order to be accurately connected to a terminal formed on the card edge substrate.

For example, in the card edge connector disclosed in JP-A-2008-098063, when the terminal fitting is inserted from behind into a cavity, a part of a body anterior to a step part is fitted between a receiving wall and a ceiling wall, and a front end of the body is stopped by a front-stop restriction wall. When the terminal fitting is thus inserted to a normal position as described above, the terminal fitting is prevented from falling off backward by a double-acting deflection locking piece and an engaging part that engages with a lance hole.

In the card edge connector disclosed in JP-A-2008-098063, a metal ring is mounted as an opening prevention member at a position corresponding to the terminal fitting around the outer periphery of the connector housing. Mounting the metal ring prevents opening deformation of the connector housing. However, there is a problem that providing the metal ring increases the whole number of parts and production cost. In addition, a mounting part should be formed in the connector housing for mounting the metal ring, and the metal ring should be formed in consideration of a shape of the mounting part and the connector housing. This complicates the design and results in high production costs.

Since the outer periphery of the connector housing is held by the metal ring, a width of the substrate insertion space is increased when a wide printed-circuit board is inserted, so that the metal ring should be correspondingly formed to have a large width. The strength of a central part of the metal ring is accordingly reduced and the opening deformation of the connector housing cannot be sufficiently prevented, so that the contact pressure with respect to the contact may be reduced.

In addition, in the card edge connector disclosed in JP-A-2008-098063, when the printed-circuit board is inserted into the connector housing of a metal terminal, the metal terminal receives pressure from one side. The metal terminal continuously receiving the pressure may move away from the printed-circuit board in the cavity. This may cause a risk that it is difficult to obtain sufficient contact pressure due to the metal terminal moving away from the printed-circuit board and a trouble may occur in a connection.

There is also a risk that the cavity itself may deform by receiving pressure from the metal terminal. The metal terminal may move in the cavity away from the printed-circuit board, so that it is difficult to obtain sufficient contact pressure. Therefore, it is difficult to prevent the metal terminal from moving in the cavity only by fitting the metal terminal in the cavity or preventing the metal terminal from falling off.

SUMMARY

In view of the foregoing, some aspects of the present invention provide a female connector connected to a card member in which a card edge terminal is provided to a substrate, wherein opening deformation of an opening of a housing to which the card member is inserted is prevented by forming a rib at the opening, and contact pressure between a contact and the card edge terminal of the card member is prevented from being reduced by providing a configuration for fixing the contact accommodated in the housing to the housing.

Another aspect of the present invention provides a card edge connector in which a card member is connected to a female connector.

A female connector according to one aspect of the present invention is connected to a card member having a card edge part in which at least one card edge terminal is formed on at least one surface. The female connector includes:

at least one contact including a connecting part connected to the card edge terminal on one side and a wire mounting part to which a wire is mounted on the other side, the connecting part and the wire mounting part being integrally formed; and a housing having a flat opening to which the card edge part is inserted on one side and an inserting part through which the wire is inserted on the other side. The housing has inside an interior space communicating with the flat opening and accommodates the card edge part, and contact accommodating parts oppositely provided with the interior space interposed therebetween and accommodating the contact positioned and fixed therein.

The interior space of the housing has on at least one spot a rib connecting one side and the other side with the flat opening of the contact accommodating part interposed therebetween.

A female connector according to one aspect is configured so that, in the female connector according to the first aspect, the connecting part of the contact has a first opening formed on the flat opening side of the housing and a second opening formed on the side in which the wire mounting part is provided, and is formed in a hollow tubular shape including a contacting part contacting the card edge terminal.

The contact accommodating part of the housing has a side wall part formed on the side surface sides of the accommodated contact and an end wall part formed on the first opening side to cover the contact, and has an opened part accommodating at least the contacting part of the contact.

The end wall part includes a protruding part fitted in the first opening of the connecting part on the side opposed to the contact.

A female connector according to one aspect is connected to a card member including a card edge part in which at least one card edge terminal is formed on at least one surface. The female connector according to the third aspect includes:

at least one contact including a connecting part connected to the card edge terminal on one side and a wire mounting part to which a wire is mounted on the other side, the connecting part and the wire mounting part being integrally formed; and a housing having a flat opening to which the card edge part is inserted on one side and an inserting part through which the wire is inserted on the other side. The housing has inside an interior space communicating with the flat opening and accommodates the card edge part, and contact accommodating parts oppositely provided with the interior space interposed therebetween and accommodating the contact positioned and fixed therein.

The connecting part of the contact has a first opening formed on the flat opening side of the housing and a second opening formed on the side in which the wire mounting part is provided, and is formed in a hollow tubular shape including a contacting part contacting the card edge terminal.

The contact accommodating part of the housing has a side wall part formed on the side surface sides of the accommodated contact and an end wall part formed on the first opening side to cover the contact, and has an opened part accommodating at least the contacting part of the contact.

The end wall part includes a protruding part fitted in the first opening of the connecting part on the side opposed to the contact.

A female connector according to one aspect is configured so that, in the female connector according to the second or third aspect, the end wall part formed at the housing is integrally and continuously formed on one side and the other side with the flat opening interposed therebetween.

A female connector according to one aspect is configured so that, in the female connector according to the second or third aspect, the connecting part is formed in a hollow rectangular parallelepiped shape having:

a rectangular bottom surface having a particular area;

one side surface and the other side surface formed by bending the bottom surface at a right angle at both edges thereof parallel to an axial direction;

a top surface formed by bending the one side surface at a right angle at an edge thereof on the opposite side to the bottom surface; and a contact segment arranged below the top surface and formed by bending the other side surface at a right angle at part of an edge thereof on the second opening side on the opposite side to the bottom surface.

The other side surface has a notch formed by cutting out the other side surface on the top surface side at a part other than an extended part in which the contact segment lies.

The notch is closed by a short side surface having a size corresponding to the notch and formed by bending the top surface on the other side surface side at a right angle at an edge thereof.

The contact segment is formed of a curved plate body, includes the contacting part contacting the card edge terminal on one side, is connected to the extended part of the other side surface on the other side, and is arranged so as to have the contacting part protruded from an aperture formed on the top surface.

The contacting part is pressed and moved by attachment/detachment of the card member and is elastically deformed in a vertical direction with respect to the extended part.

A female connector according to one aspect is configured so that, in the female connector according to the fifth aspect, the bottom surface of the contact has an opened locking hole.

The contact accommodating part has a locking protrusion locked to the locking hole on the side where the bottom surface of the contact is arranged when the contact is accommodated therein.

The locking hole is locked to the locking protrusion when the contact is accommodated in the contact accommodating part.

A female connector according to one aspect is configured so that, in the female connector according to the fifth or sixth aspect, the one side surface or the other side surface of the contact includes a regulation part for regulating a movable range in which the contact segment is pressed down.

A female connector according to one aspect is configured so that, in the female connector according to any one of the first to seventh aspects, the housing is provided with an annular sealing member formed of an elastic material at an outer circumference thereof on the side to which the card member is connected, and the sealing member is formed to have a size to be sealed with part of the card member when the card member is connected to the housing.

A female connector according to one aspect is configured so that, in the female connector according to the eighth aspect, the outer side of the housing and the sealing member is mounted with a hollow exterior covering member having an insertion slot to which the card member is inserted on one side and an insertion port through which the wire is inserted on the other side.

The exterior covering member is formed in a size to cover the card member connected.

A female connector according to one aspect is configured so that, in the female connector according to the ninth aspect, the exterior covering member has a guide groove to which a guide protrusion formed on the card member is guided and fitted.

A female connector according to one aspect is configured so that, in the female connector according to the ninth or tenth aspect, the exterior covering member includes a coupling part coupled to a lock part formed in the card member.

A card edge connector according to one aspect includes:

the female connector according to any one of the first, second, and fourth to eleventh aspects; and the card member in which the card edge part has a slit corresponding to the rib formed in the housing of the female connector.

A card edge connector according to one aspect includes:

the female connector according to any one of the third to eleventh aspects; and the card member connected to the female connector.

Generally, a flat opening of a housing to which a card member is mounted is formed to have a large width. Consequently, a central part of the housing easily deforms toward the outside, and especially easily deforms under high temperature due to heat. With the female connector of the above aspect, a rib is formed that connects one side and the other side of the contact accommodating part formed with a flat opening interposed therebetween, which can prevent deformation of the flat opening. In a case where the number of the card edge terminals and a width of a substrate are increased, the width of the housing is correspondingly increased and consequently the central part of the flat opening tends to be easily deformed. With the female connector of the first aspect, deformation of a wide and large housing can also be prevented by forming ribs for preventing deformation at a plurality of points. Preventing the deformation of the flat opening can prevent loss of contact pressure between the contact and the card edge terminal when the card member is connected. In addition, by forming a groove or slit corresponding to the rib in the card member to be connected to the female connector, the rib can accurately guide the card member to a particular position when the card member is connected. This can prevent misconnection between the card edge terminal of the card member and the contact of the female connector.

With the female connector of the above aspects, the contact accommodated in the contact accommodating part is surrounded by a side wall part and an end wall part integrally formed with the housing. The end wall parts arranged in a width direction are integrally and firmly formed. The protruding part formed on the end wall part is fitted in a first opening formed on the contact, so that the contact can be firmly fixed to the housing. This can prevent loss of contact pressure when connected to the card member.

With the female connector of one of the above aspects, the housing can be firmly formed. This can prevent movement of the contact within the contact accommodating part and can further prevent the loss of the contact pressure.

With the female connector of one of the above aspects, the contact can be efficiently formed by bending one plate body to integrally form the connecting part having the contacting part of the contact. In addition, a rectangular parallelepiped can be more firmly formed by aligning ends of the rectangular parallelepiped of the contact formed by bending the plate body at side surfaces, compared to a case in which the ends are aligned at corners. With the female connector of the third aspect, because the ends are not at the corners, the corners are not caught by a contact accommodating part in assembling and the assembly is facilitated. In addition, by forming the contacting part at a contact segment elastically deformed, displacement of the contacting part can be increased and this enables secure contact with the card edge part of a substrate having a large tolerance in thickness.

With the female connector of one of the above aspects, the contact can be securely accommodated in the contact accommodating part, and the contact can be prevented from falling off from the contact accommodating part.

With the female connector of one of the above aspects, deformation of the contacting part can be kept within a certain range even when external force is applied to the contact, which can prevent reduction in the contact pressure.

With the female connector of one of the above aspects, the female connector can be sealed together with the card member by the sealing member provided in the housing of the female connector, which enhances water proofing property thereof.

With the female connector one of the above aspects, the card member connected can be covered with the exterior covering member, which leads to the female connector that prevents the card member from being damaged due to a collision or the like.

With the female connector of one of the above aspects, the card member is covered with the exterior covering member. The guide groove formed in the exterior covering member accordingly guides the guide protrusion formed in the card member, so that connection is securely established. With the female connector of the eighth aspect, the guide groove of the exterior covering member is engaged with the guide protrusion of the card member. Therefore, if the female connector vibrates, the card member also vibrates with the exterior covering member, which can prevent the card member from vibrating independently. This can prevent load on the card edge terminal of the card member connected to the contact.

With the female connector of one of the above aspects, the coupling part formed in the exterior covering member is coupled with the lock part formed in the card member, which can prevent the card member from falling off from the exterior covering member.

With the card edge connector of one of the above aspects, a card edge connector including a female connector as in any one of the first, second, and fourth to eleventh aspects can be obtained. In addition, the card edge part of the card member is formed with the slit corresponding to the rib formed in the housing of the female connector, which enables positioning and can prevent misconnection. Furthermore, the contact is fitted in the protruding part formed in the housing, which can prevent the movement of the contact within the contact accommodating part even when pressure is applied when the card member is connected. This can prevent the loss of the contact pressure.

With the card edge connector of one of the above aspects, a card edge connector including a female connector as in any one of the third to eleventh aspects can be obtained. In addition, the contact is fitted in the protruding part formed in the housing, which can prevent the movement of the contact within the contact accommodating part even when pressure is applied when the card member is connected. This can prevent the loss of the contact pressure.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the drawings. However, the embodiments described below only exemplify a female connector and a card edge connector for the purpose of embodying the technical idea of the invention and are not intended to limit the invention thereto. The present invention is also applicable to other embodiments included in the scope of claims.

[Embodiment 1]

Figure 1:
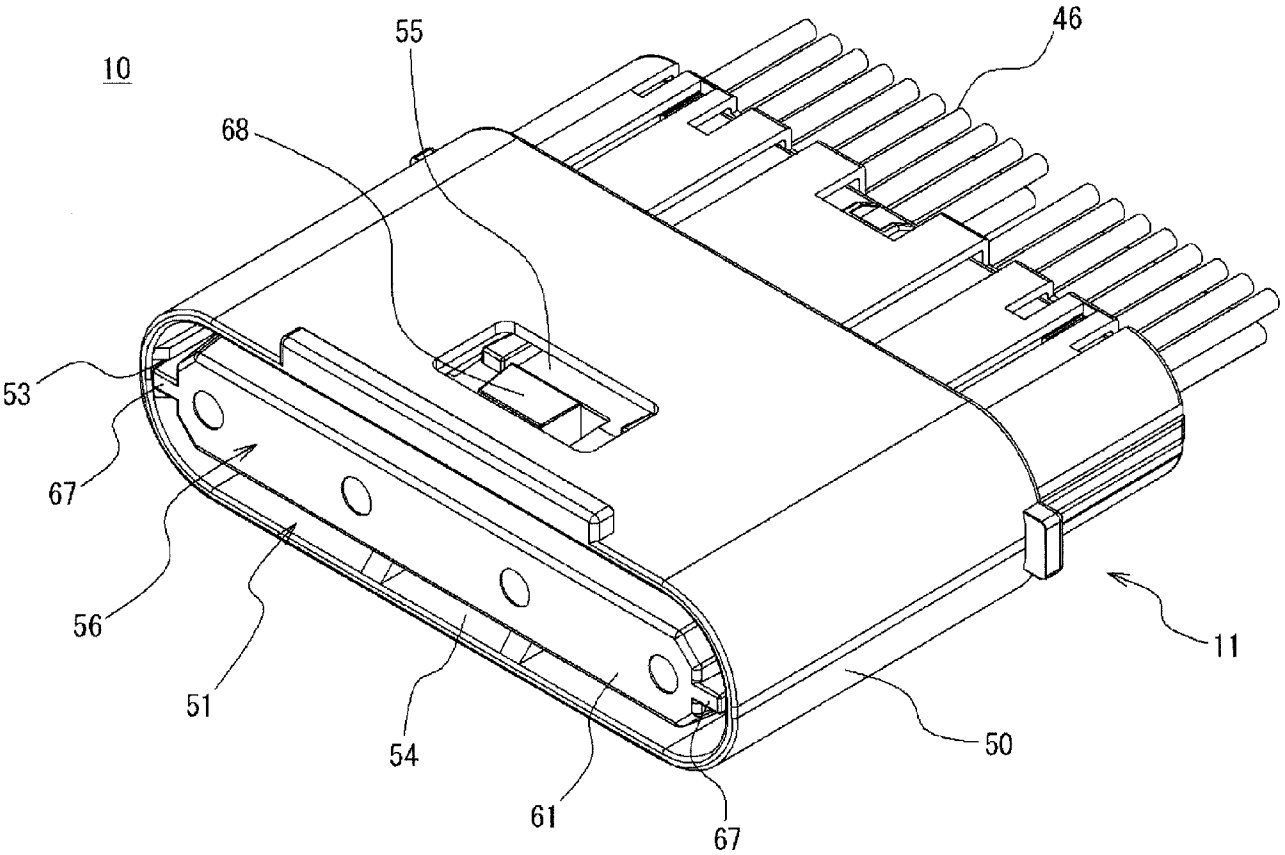
FIG. 1 is a perspective view of a card edge connector according to Embodiment

With reference to FIG. 1 to FIG. 9, a card edge connector 10 according to Embodiment 1 will be described. As illustrated in FIG. 1, the card edge connector 10 includes a female connector 11 and a card member 56 connected to the female connector 11.

Figures 2A, 2B, 2C, 2D, 2E, 2F:
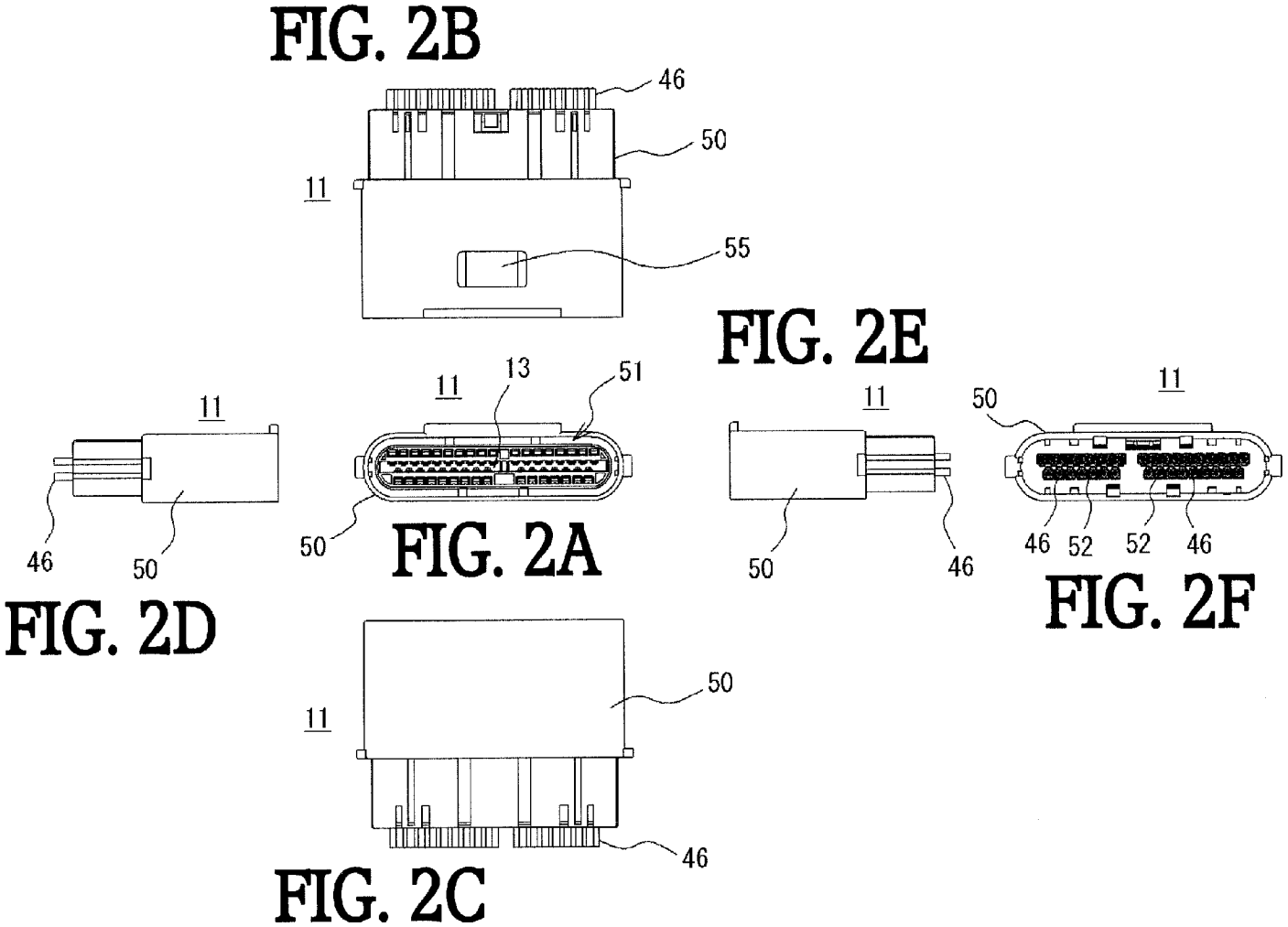
FIG. 2A is a front view of a female connector according to Embodiment 1.
FIG. 2B is a top view thereof.
FIG. 2C is a bottom view thereof.
FIG. 2D is a side view thereof viewed from one side.
FIG. 2E is a side view thereof viewed from the other side.
FIG. 2F is a back view thereof.
Figure 3:
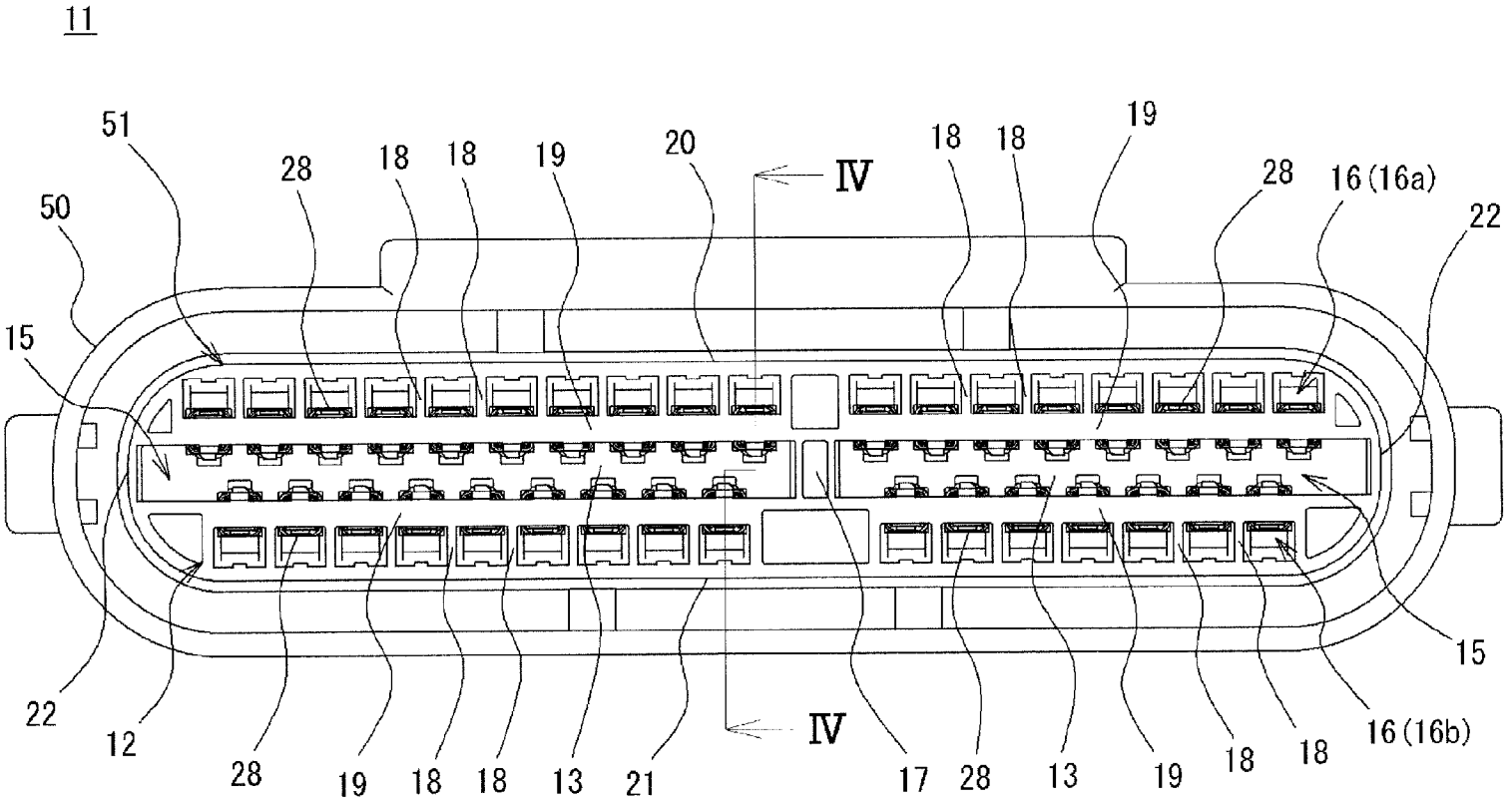
FIG. 3 is a front view of the female connector according to Embodiment 1.
Figure 4:
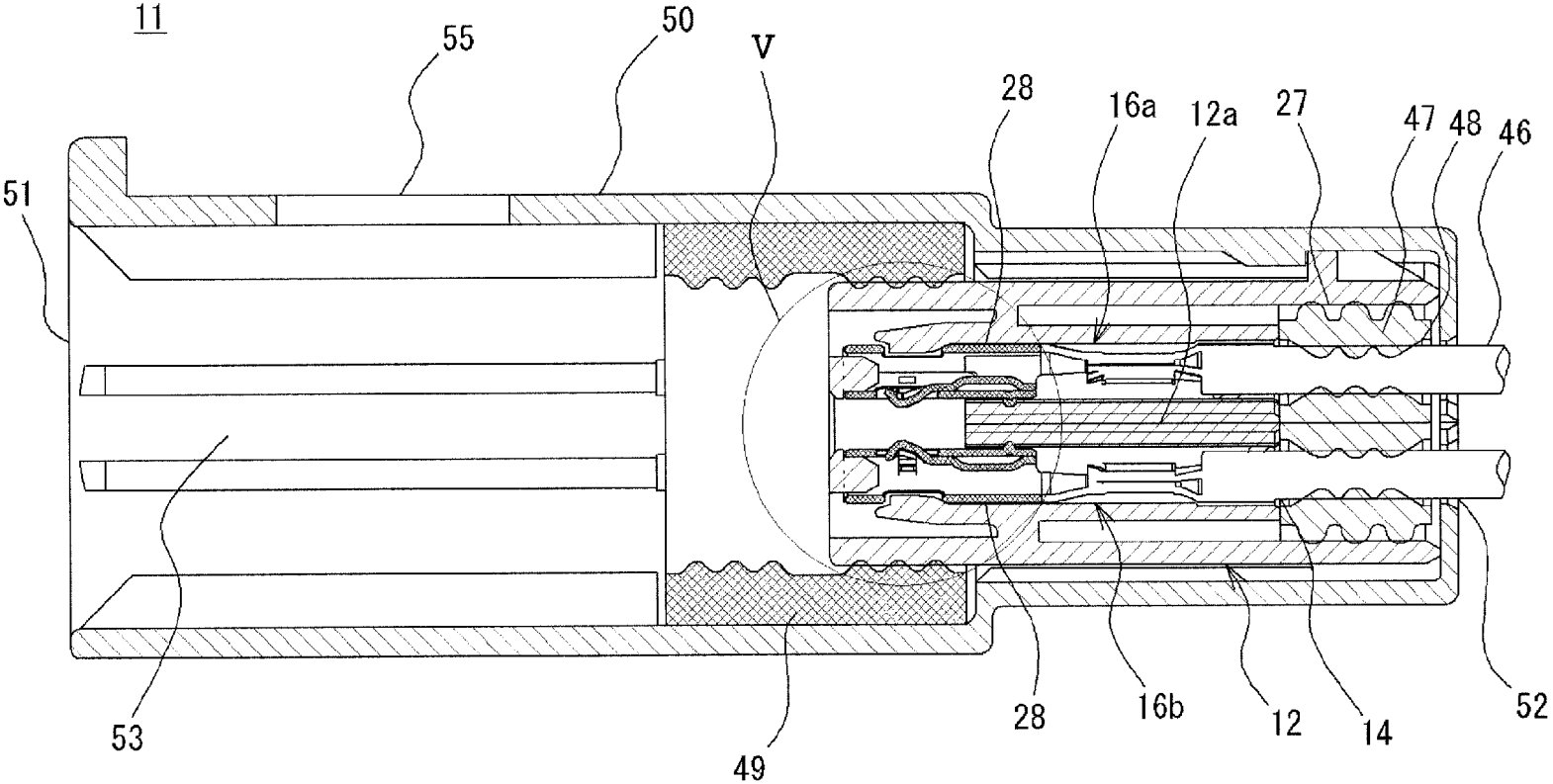
FIG. 4 is a sectional view taken along line IV-IV of FIG. 3 and FIG. 12.

First, the female connector 11 will be described with reference to FIG. 1 to FIG. 7. As illustrated in FIG. 2 to FIG. 4, the female connector 11 includes a plurality of wires 46 connected to external devices, a plurality of contacts 28 to which the wires 46 are mounted and that are connected to a card member, and a housing 12 in which a contact accommodating part 16 (16*a*, 16*b*) supporting and fixing the contacts 28 therein is formed. The housing 12 is provided with an annular sealing member 49 at an outer circumference of the housing 12 on the side to which the card member is connected. A wire seal 47 is provided to the inner side of the housing 12 on the opposite side to the side on which the sealing member 49 is provided. An exterior covering member 50 formed so as to cover the housing 12 and the sealing member 49 is provided on the outer side of the housing 12 and the sealing member 49. Hereinafter, each of the components will be described.

Figure 5:
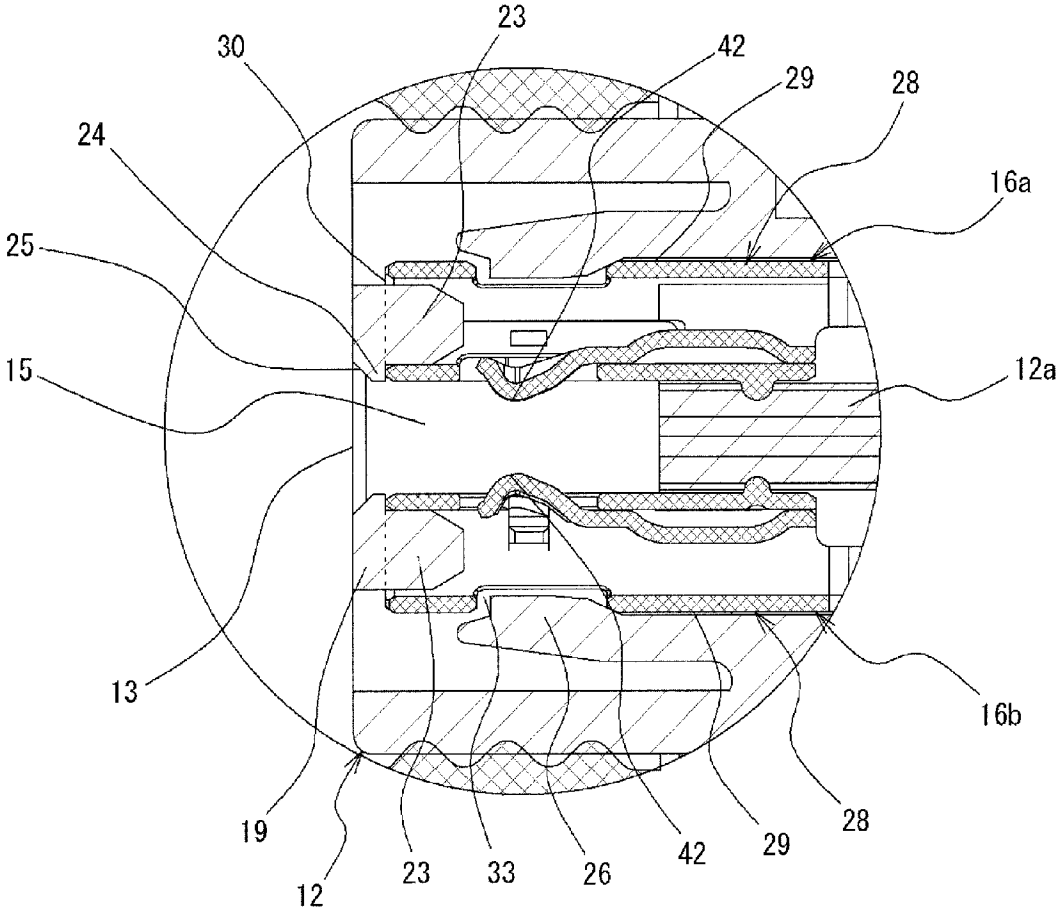
FIG. 5 is an enlarged sectional view of part V in FIG. 4.

As illustrated in FIG. 3 to FIG. 5, the housing 12 includes a flat opening 13 on one side and an inserting part 14 on the other side. The flat opening 13 is formed to be wide in a width direction to which a card edge part 58 of the card member 56 is inserted and connected. Through the inserting part 14, a wire 46 is inserted. The housing 12 is provided inside with an interior space 15 communicating with the flat opening 13. The housing 12 is a flat tubular body in which the contact accommodating parts 16 communicating with the inserting part 14 are provided at the upper side and the lower side opposed to each other with the interior space 15 and an internal structure 12*a* of the housing 12 interposed therebetween. The interior space 15 provided inside the housing 12 is a part where the card edge part 58 of the connected card member 56 is arranged, and the contact accommodating part 16 is a part where the contact 28 is positioned and fixed to be accommodated. A wire seal mounting part 27 to which the wire seal 47 is mounted is provided inside the housing 12 on the inserting part 14 side.

In the contact accommodating part 16, each of an upper contact accommodating part 16*a* (hereinafter, also simply referred to as an upper side 16*a*) and a lower contact accommodating part 16*b* (hereinafter, also simply referred to as a lower side 16*b*) opposed to each other with the interior space 15 and the internal structure 12*a* of the housing 12 interposed therebetween includes an accommodating space in which each of the contacts 28 is accommodated. The upper side 16*a* and the lower side 16*b* of the contact accommodating part 16 are alternately formed. The upper side 16*a* and the lower side 16*b* of the contact accommodating part 16 each have a side wall part 18 formed on the side surface side of the contact 28 to be accommodated, and an end wall part 19 formed on the flat opening 13 side of the housing 12, so that the contact 28 is covered with the side wall part 18 and the end wall part 19.

The end wall part 19 of the contact accommodating part 16 is formed such that the upper side 16*a* and the lower side 16*b* opposed to each other with the flat opening 13 interposed therebetween are integrally connected. The end wall parts 19 of the upper side 16*a* and the lower side 16*b* are also connected to a side surface side 22 of the housing 12. The side wall parts 18 of the upper side 16*a* and the lower side 16*b* lie opposite from the flat opening 13 and the interior space 15 side so as to be connected to a top surface side 20 and a bottom surface side 21 of the housing 12, respectively. As described above, the end wall part 19 and the side wall part 18 of the contact accommodating part 16 are connected to and integrally formed with the side surface side 22, the top surface side 20, and the bottom surface side 21 of the housing 12, thereby enhancing the strength of the contact accommodating part 16.

The end wall part 19 includes a protruding part 23 having a particular length formed on the contact accommodating part 16 side so as to correspond to the accommodated contact 28. The protruding part 23 is formed to have a cylindrical shape or a prism shape, for example. In the contact accommodating part 16, the end wall part 19 of each of the upper side 16*a* and the lower side 16*b* has a convex part 24 for regulating insertion of the contact 28 when the contact 28 is inserted.

In the end wall part 19 of each of the upper side 16*a* and the lower side 16*b*, the convex part 24 has a taper 25 on the flat opening 13 side so that the card edge part 58 inserted of the card member 56 can be smoothly introduced into the interior space 15. In this case, the convex part 24 of the end wall part 19 functions as a wall against the contact 28 placed on the side to which the card edge part 58 is inserted, thereby preventing a tip of the card edge part 58 from contacting an end of the contact 28 and preventing damage on the card edge part 58.

In the upper side 16*a* and the lower side 16*b* of the contact accommodating part 16, the side to which the card edge part 58 is inserted is at least partially opened, so that the contact 28 accommodated can be connected to the card edge terminal 59. A locking protrusion 26 that is locked to the accommodated contact 28 is formed on the side opposite from the side where the contact accommodating part 16 is opened.

The housing 12 has a rib 17 formed integrally therewith that connects the upper side 16*a* and the lower side 16*b* of the contact accommodating part 16 from the flat opening 13 toward the interior space 15. The rib 17 extends from the end wall part 19 of the contact accommodating part 16 toward the interior space 15 of the housing 12 in the depth direction thereof so as to be integrated with the internal structure 12*a*. In this case, the rib 17 is formed to be also integrated with the upper side 16*a* and the lower side 16*b* from the end wall part 19 to the internal structure 12*a*. The rib 17 thus formed can prevent deformation of the flat opening 13 and the interior space 15 even when the flat opening 13 of the housing 12 is formed to have a large width. The rib 17 is formed at one position in FIG. 3, but the embodiment is not limited thereto and the ribs 17 may be formed at a plurality of positions. Forming the ribs at a plurality of positions can prevent deformation of a large housing having a widened flat opening that is connected to a wide card member including many card edge terminals.

Next, the contact 28 will be described with reference to FIG. 4 to FIG. 7. The contact 28 is electrically connected to the card edge part 58 (refer to FIG. 9) of the card member 56. The contact includes a connecting part 29 connected to the card edge terminal 59 on one side and a wire mounting part 44 to which the wire 46 is mounted on the other side, and a connecting part 29 and a wire mounting part 44 are integrally formed. The contact 28 is formed by, for example, pressing and folding a punched metal plate body.

The connecting part 29 has a first opening 30 formed on the flat opening 13 side when the contact 28 is accommodated in the contact accommodating part 16 and a second opening 31 formed on the wire mounting part 44 side. The connecting part 29 is formed in a hollow tubular shape including a bottom surface 32, one side surface 34, the other side surface 36, and a top surface 38, for example.

The bottom surface 32 included in the connecting part 29 is formed in a rectangular having a particular area. The bottom surface 32 has both ends, parallel to the axial direction of the bottom surface 32, bent at a right angle to form the one side surface 34 and the other side surface 36. The one side surface 34 has an end on the opposite side to the bottom surface 32 side bent at a right angle to form the top surface. The other side surface 36 has part of an edge on the second opening 31 side on the opposite side to the bottom surface 32 side bent at a right angle to form a contact segment 41 arranged below the top surface.

The other side surface 36 has a notch 37 formed by cutting out the other side surface 36 on the top surface 38 side at a part other than an extended part 43 in which the contact segment 41 lies in an upper part of the other side surface 36. The top surface 38 has a short side surface 39 having a size corresponding to the notch 37 and formed by bending the top surface 38 at a right angle at an edge on the other side surface 36 side. The notch 37 is closed by the short side surface 39. With such a structure, the connecting part 29 is formed in a hollow rectangular parallelepiped shape.

The contact segment 41 is formed of a curved plate body. The contact segment 41 includes a contacting part 42 contacting the card edge terminal 59 on one side, and is connected to the extended part 43 connected to the other side surface 36 is integrally provided on the other side. An aperture 40 is formed on the top surface 38, and the contacting part 42 provided on the contact segment 41 is arranged so that it protrudes from the aperture 40.

In this manner, at the connecting part 29, the contacting part 42 is pressed and moved by the card edge terminal 59 when the card member 56 is attached or detached and elastically deformed in a vertical direction with respect to the extended part 43, so that sufficient contact pressure can be obtained even if there is a strain at the card edge part.

The bottom surface 32 of the contact 28 has a locking hole 33 and can be locked to the locking protrusion 26 formed in the contact accommodating part 16 of the housing 12. The contact 28 includes on the one side surface 34 side a regulation part 35 for regulating a movable range in which the contact segment 41 is pressed down by connection with the card member 56. The regulation part 35 is formed by bending part of the one side surface 34. Forming the regulation part 35 leads to deformation of the contacting part 42 of the contact 28 within a certain range, thereby preventing reduction in the contact pressure between the card edge terminal 59 and the contact 28.

Figure 6:
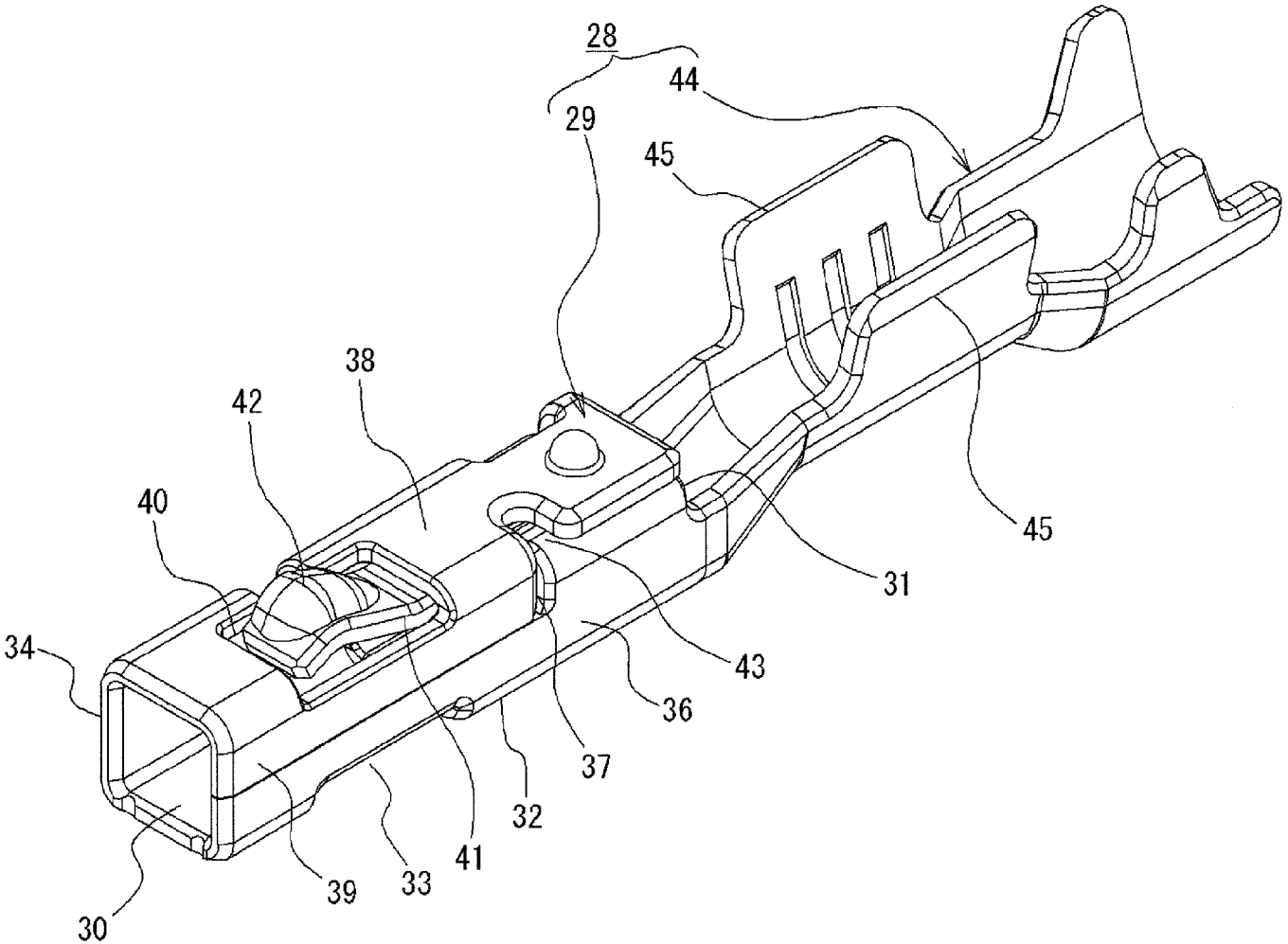
FIG. 6 is a perspective view of a contact according to Embodiment 1 and Embodiment 2.
Figure 7A:
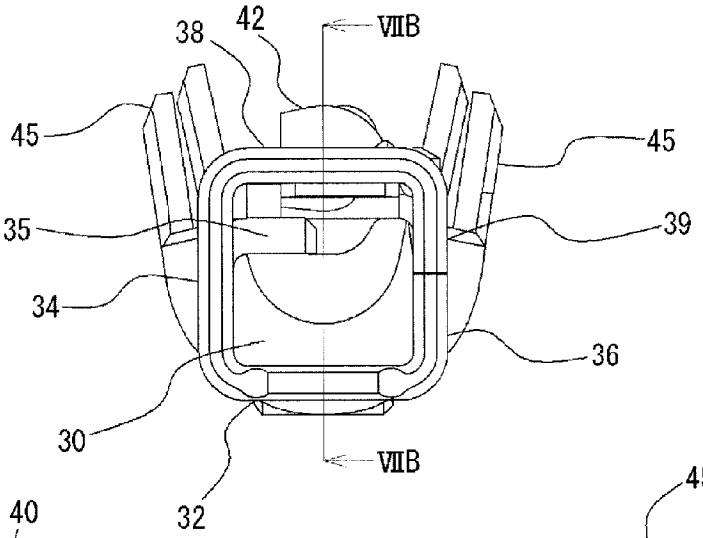
FIG. 7A is a front view of the contact.
Figure 7B:
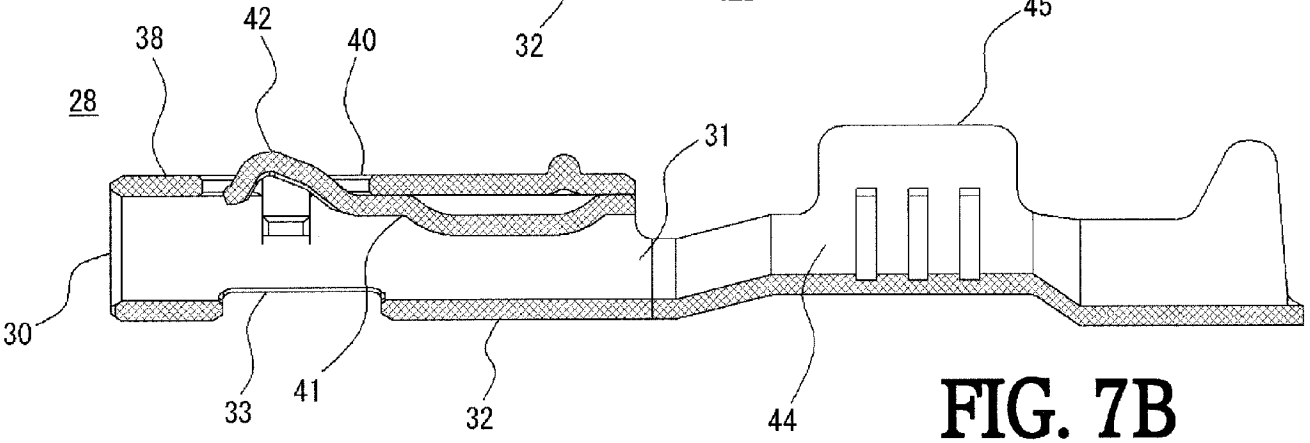
FIG. 7B is a sectional view taken along line VIIB-VIIB of FIG. 7A.

As illustrated in FIG. 6, piece parts 45 on both sides of the wire mounting part 44 is upwardly formed when the wire 46 is not mounted. When the wire 46 is mounted, the piece parts 45 on both sides are bent to hold the wire 46 therebetween, so that the contact 28 is mounted to the wire 46. One end of the wire 46 is mounted to the contact 28 and the other end thereof is connected to external electronic equipment and the like to exchange an electric signal between the card edge connector 10 and the external equipment.

As illustrated in FIG. 4, the wire seal 47 has a plurality of through holes 48 through which the wire 46 passes and is formed of an elastic member having a shape that enables the wire seal 47 to be mounted to the wire seal mounting part 27 of the housing 12. The wire seal 47 fixes the wire 46 arranged in the housing 12 and prevents liquid and the like from entering from the side where the wire 46 is arranged.

As illustrated in FIG. 4, the sealing member 49 is arranged at the outer circumference of the housing 12 on the flat opening 13 side and is formed in a large tubular shape that protrudes from the end of the housing 12. A card member 56 connected is fitted in the protruded inner side of the sealing member 49. Projections and depressions are annularly formed on the inner side of the sealing member 49.

As illustrated in FIG. 2 and FIG. 4, the exterior covering member 50 is formed in a size to cover the housing 12 and the sealing member 49 attached to the housing, and the card member 56 connected to the housing 12. The exterior covering member 50 is formed in a tubular shape having an insertion slot 51 to which the card member 56 on one side thereof and an insertion port 52 through which the wire 46 is inserted on the other side thereof. An upper part of the exterior covering member 50 is provided with a coupling hole 55 that is used when connected to the card member 56. The exterior covering member 50 has inside an engaging groove 54 and a guide groove 53.

Next, assembly of the female connector 11 will be described with reference to FIG. 4 and FIG. 5. In assembling the female connector 11, first, the wire 46 is mounted to the wire mounting part 44 of the contact 28. As described above, the wire 46 is fixed by bending the piece parts 45 on both sides of the wire mounting part 44 of the contact 28 to hold the wire 46 therebetween.

Next, the contact 28 with the wire 46 mounted is inserted into the insertion port 52 of the exterior covering member 50, so that the wire 46 is inserted through the exterior covering member 50 in advance. In this case, the contact 28 protrudes from the insertion port 52 of the exterior covering member 50, thereby facilitating subsequent assembly.

The contact 28 with the wire 46 mounted is then attached to the housing 12. In this attachment, the wire seal 47 is mounted to the wire seal mounting part 27 of the housing 12 in advance, and the contact 28 is inserted along with the through hole 48 of the wire seal 47 from the inserting part 14 side of the housing 12 in which, so that the contact 28 is accommodated in the contact accommodating part 16. In this case, the contact 28 is inserted such that each of the contacting parts 42 of the connecting part 29 of the contact 28 faces the interior space 15 side of the housing 12 on the upper side and the lower side of the contact accommodating part 16.

The contact 28 is inserted such that the protruding part 23 formed at the end wall part 19 of the housing 12 is fitted in the first opening 30 of the contact 28 and the locking protrusion 26 of the contact accommodating part 16 is locked to the locking hole 33 of the contact 28 (refer to FIG. 5). The contact 28 is thus fitted in the protruding part 23 of the end wall part 19 of the contact accommodating part 16, so that the contact 28 is firmly fixed to the contact accommodating part 16. This can prevent loss of the contact pressure when the contact 28 is connected to the card member 56.

The sealing member 49 is then attached to the housing 12, and the housing 12 is arranged inside the exterior covering member 50, so that the assembly of the female connector 11 is completed.

Next, connection of the card member 56 to the female connector 11 will be described. The card member 56 according to Embodiment 1 will be described first with reference to FIG. 8. The card member 56 includes: a substrate 57 on which circuit wiring and the like are printed and a plurality of card edge terminals 59 to contact with the contact 28 included in the female connector 11 are formed on one end thereof; and a resin molded part 61 integrally molded with a synthetic resin material so that the card edge part of the substrate 57 protrudes.

The substrate 57 (refer to FIG. 9) has a printed circuit or an integrated circuit, for example, mounted on the front side or back side thereof. The substrate 57 includes, at the end thereof, the card edge part 58 in which a plurality of card edge terminals 59 to contact with and electrically connected with the contact 28 of the female connector 11. The card edge terminals 59 are formed of an electrical conducting material conducted with the circuit wiring and the like formed on the substrate 57 and are arranged at particular intervals so as to be alternate on the front side and the back side. In addition, the card edge part 58 has a slit 60 formed at a position slightly shifted from the center thereof. The slit 60 is a part to be fitted in the rib 17 formed in the housing 12 of the female connector 11 when the card edge part 58 is connected to the female connector 11, that is, a part used for positioning or preventing reverse attachment of the card member, for example. The slit 60 and the rib 17 formed in the housing 12 of the female connector 11 are formed having corresponding size and number.

The resin molded part 61 is formed in a low-profile rectangular parallelepiped shape so as to enclose the substrate 57. The top surface 62 and the bottom surface 65 of the resin molded part 61 have engaging protrusions 69 used for guiding or positioning when the resin molded part 61 is connected to the female connector 11. Both side surfaces 63 and 64 of the resin molded part 61 have guide protrusions 67. The top surface 62 of the resin molded part 61 has a lock part 68 coupled to the female connector 11 substantially at the center thereof.

Figure 8:
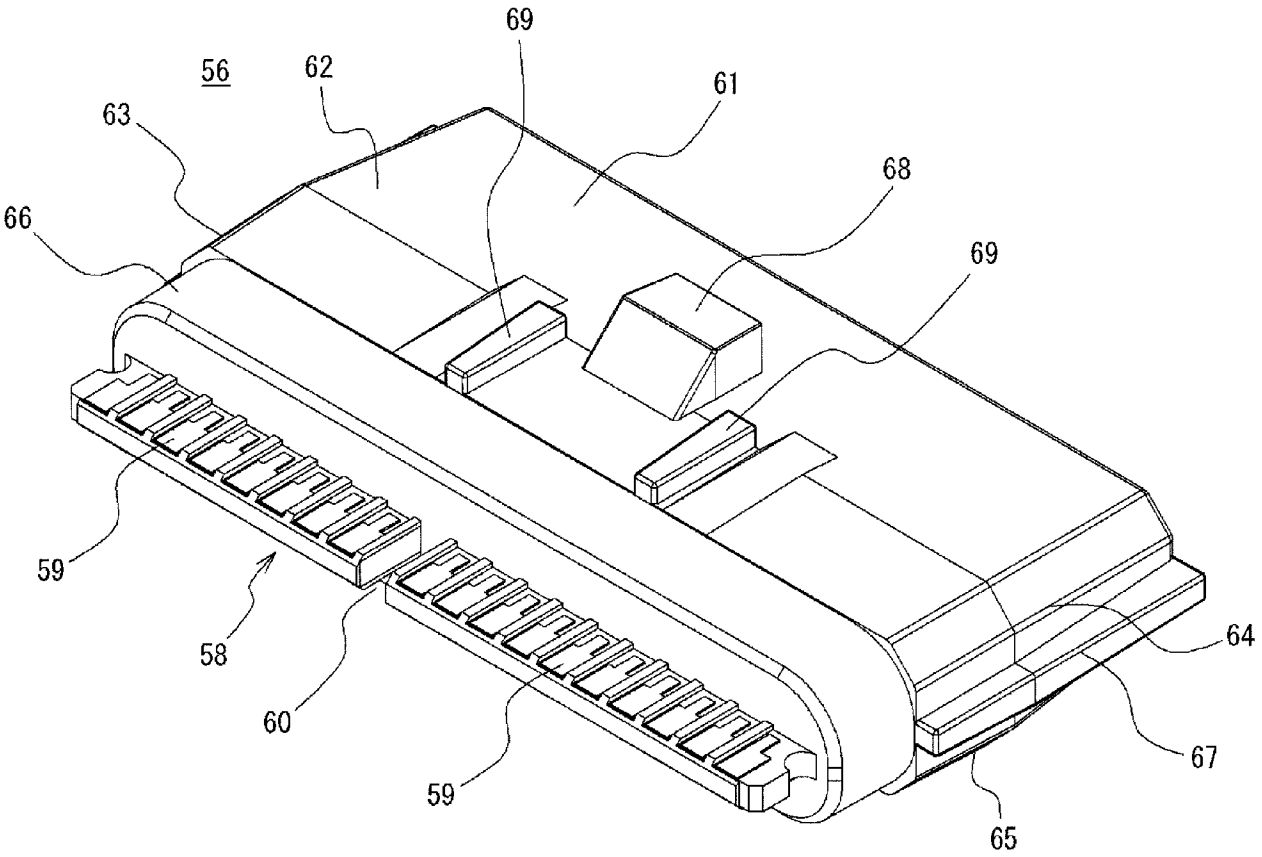
FIG. 8 is a perspective view of a card member according to Embodiment 1.
Figure 9A:
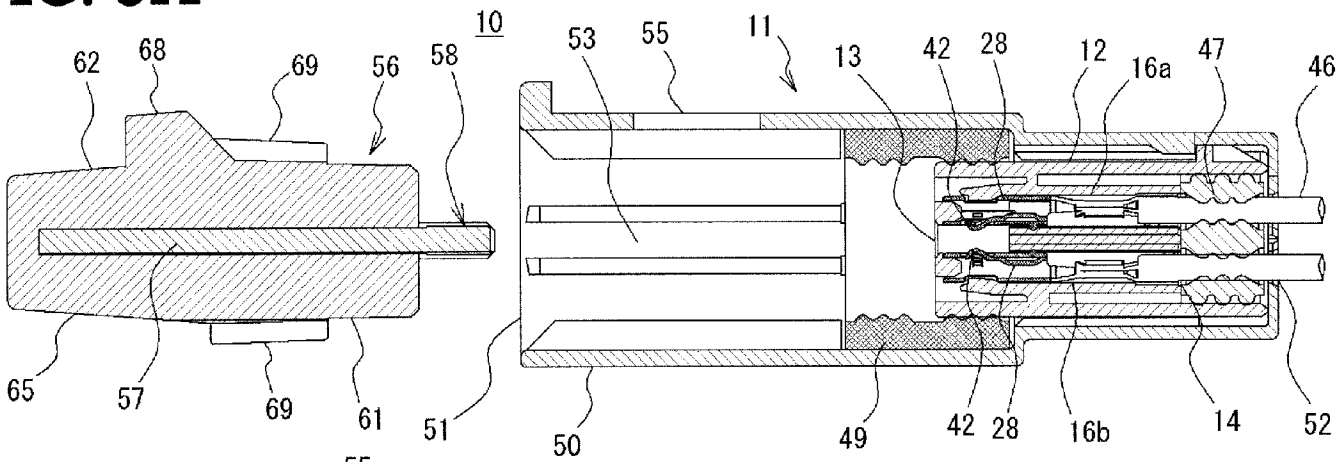
FIG. 9A and FIG. 9B are sectional views illustrating a connecting process of the card edge connector.
Figure 9B:
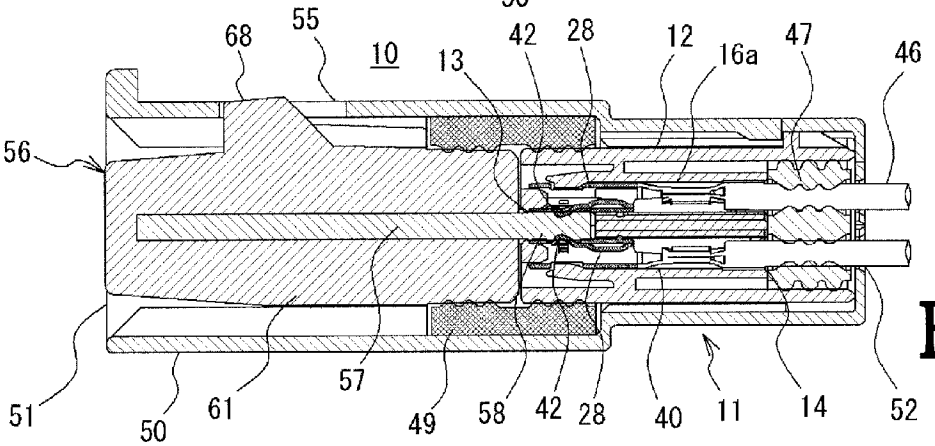

The resin molded part 61 has an annular engaging part 66 at a part connected to the female connector 11 on the side where the card edge part 58 protrudes. As illustrated in FIGS. 8 and 9, the engaging part 66 is formed at the outer circumference of the resin molded part 61 where the card edge part 58 protrudes, and is engaged with the sealing member 49 provided in the female connector 11 when the card member 56 is connected to the female connector 11.

Next, connection of the card member 56 to the female connector 11 will be described with reference to FIG. 9. To connect the female connector 11 with the card member 56, first, the card member 56 is inserted into the insertion slot 51 of the exterior covering member 50 with the card edge part 58 of the card member 56 being in the lead. In this case, the positions of the engaging groove 54 and the guide groove 53 of the exterior covering member 50 and the engaging protrusion 69 and the guide protrusion 67 of the card member 56 are aligned, respectively, for the insertion. The slit 60 formed at the card edge part 58 of the card member 56 is engaged with the rib 17 formed at the flat opening 13 of the housing 12. In this case, the rib is fitted in the slit formed at the card member, so that the rib can accurately guide the card member to a particular position when the card member is connected. This can prevent misconnection between the card edge terminal of the card member and the contact of the female connector.

Subsequently, the insertion is continued to connect the connecting part 29 of the contact 28 to the card edge terminal 59, the coupling hole 55 of the exterior covering member 50 is coupled to the lock part 68 of the card member 56, and the sealing member 49 provided in the female connector 11 is engaged with the engaging part 66 of the card member 56 to complete the connection.

With the card edge connector 10 thus assembled, the rib 17 is formed in the housing 12 of the female connector 11, thereby preventing deformation of the flat opening 13 connected to the card edge terminal 59 and preventing loss of the contact pressure. In the contact accommodating part 16 accommodating the contact 28, the end wall part 19 having a protruding part 23 in which the contact 28 is fitted formed thereon is formed integrally with the housing 12, so that the contact 28 can be firmly fixed. This can prevent loss of the contact pressure.

The card member 56 is covered with the exterior covering member 50 provided to the female connector 11, thereby preventing the card member 56 from being damaged due to a collision or the like. The exterior covering member 50 of the female connector 11 formed so as to cover the card member 56 causes the guide protrusion 67 formed on the card member 56 to be guided by the guide groove 53 formed in the exterior covering member 50 of the female connector 11, thereby securely performing the connection.

The guide protrusion 67 is formed at the part other than the engaging part on the side surface of the card member 56, and the guide protrusion 67 is engaged with the guide groove 53 of the exterior covering member 50 of the female connector 11. Therefore, the card member 56 vibrates together with the card edge connector 10, which can prevent the card member 56 from vibrating independently. This can prevent load on the card edge terminal 59 connected between the card member 56 and the female connector 11.

[Embodiment 2]

In the above Embodiment 1 of the female connector 11 and the card edge connector 10, it is described that the flat opening 13 of the housing 12 of the female connector 11 is formed with rib 17, and that card edge 58 of the card member 56 of the card edge connector 10 is formed with the slit 60. In the following Embodiment 2 of the female connector 11A and the card edge connector 10A, it is described that the flat opening 13A of the housing 12A of the female connector 11A is formed with no ribs, and that card edge 58A of the of the card member 56A of the card edge connector 10A is not formed with no slits. In the following explanation, identical codes are given to the corresponding elements without adding explanations since the female connector 11A and the card edge connector 10A of the Embodiment 2 correspond to the female connector 11 and the card edge connector 10 of the Embodiment 1 except for the Embodiment 1 only having the rib and slit.

Figure 10:
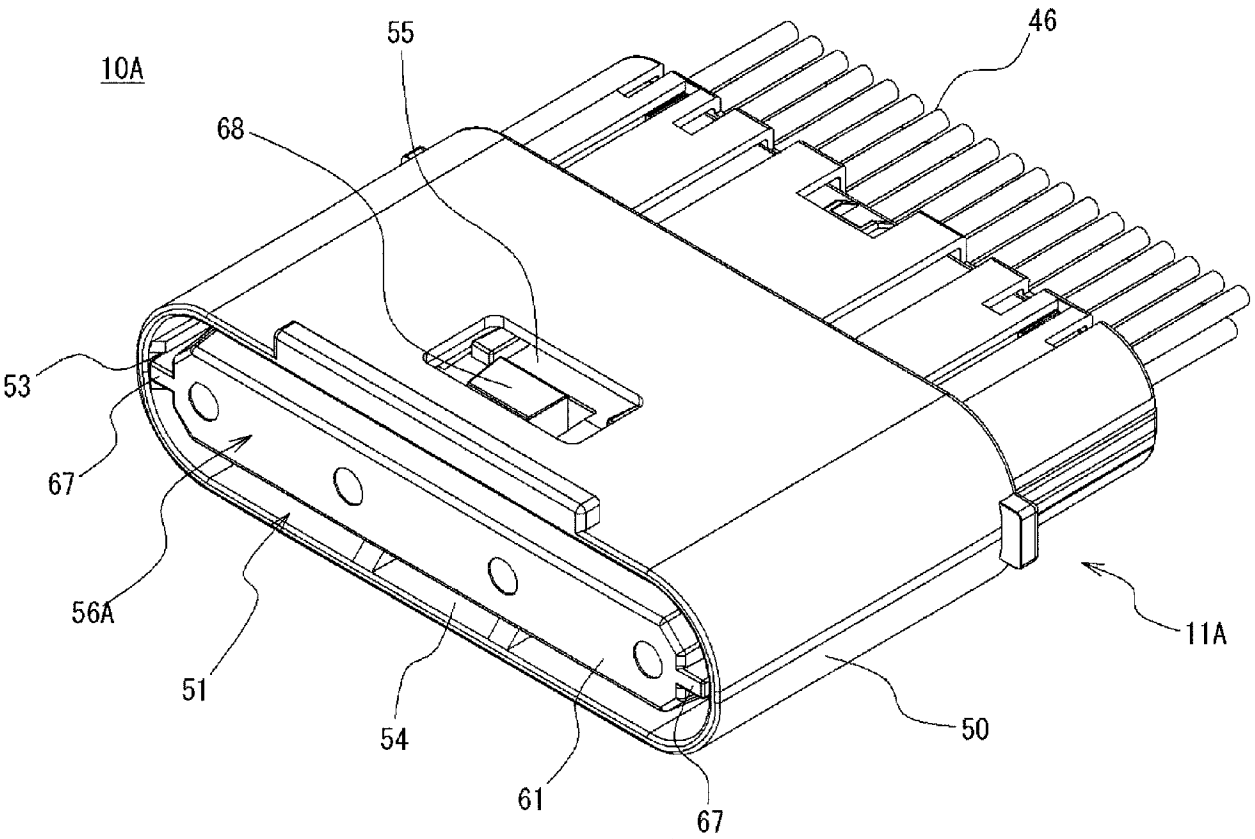
FIG. 10 is a perspective view of a card edge connector according to Embodiment 2.

With reference to FIGS. 6 and 7, and FIG. 10 to FIG. 15, a card edge connector 10A according to Embodiment 2 will be described. As illustrated in FIG. 10, the card edge connector 10A includes a female connector 11A and a card member 56A connected to the female connector 11A.

First, the female connector 11A will be described with reference to FIGS. 6 and 7, and FIG. 10 to FIG. 14. As illustrated in FIG. 11 to FIG. 14, the female connector 11A includes a plurality of wires 46 connected to external devices, a plurality of contacts 28 to which the wires 46 are mounted and that are connected to a card member, and a housing 12A in which a contact accommodating part 16 (16*a*, 16*b*) supporting and fixing the contacts 28 therein is formed. The housing 12A is provided with an annular sealing member 49 at an outer circumference of the housing 12A on the side to which the card member is connected. A wire seal 47 is provided to the inner side of the housing 12A on the opposite side to the side on which the sealing member 49 is provided. An exterior covering member 50 formed so as to cover the housing 12A and the sealing member 49 is provided on the outer side of the housing 12A and the sealing member 49. Hereinafter, each of the components will be described.

Figure 12:
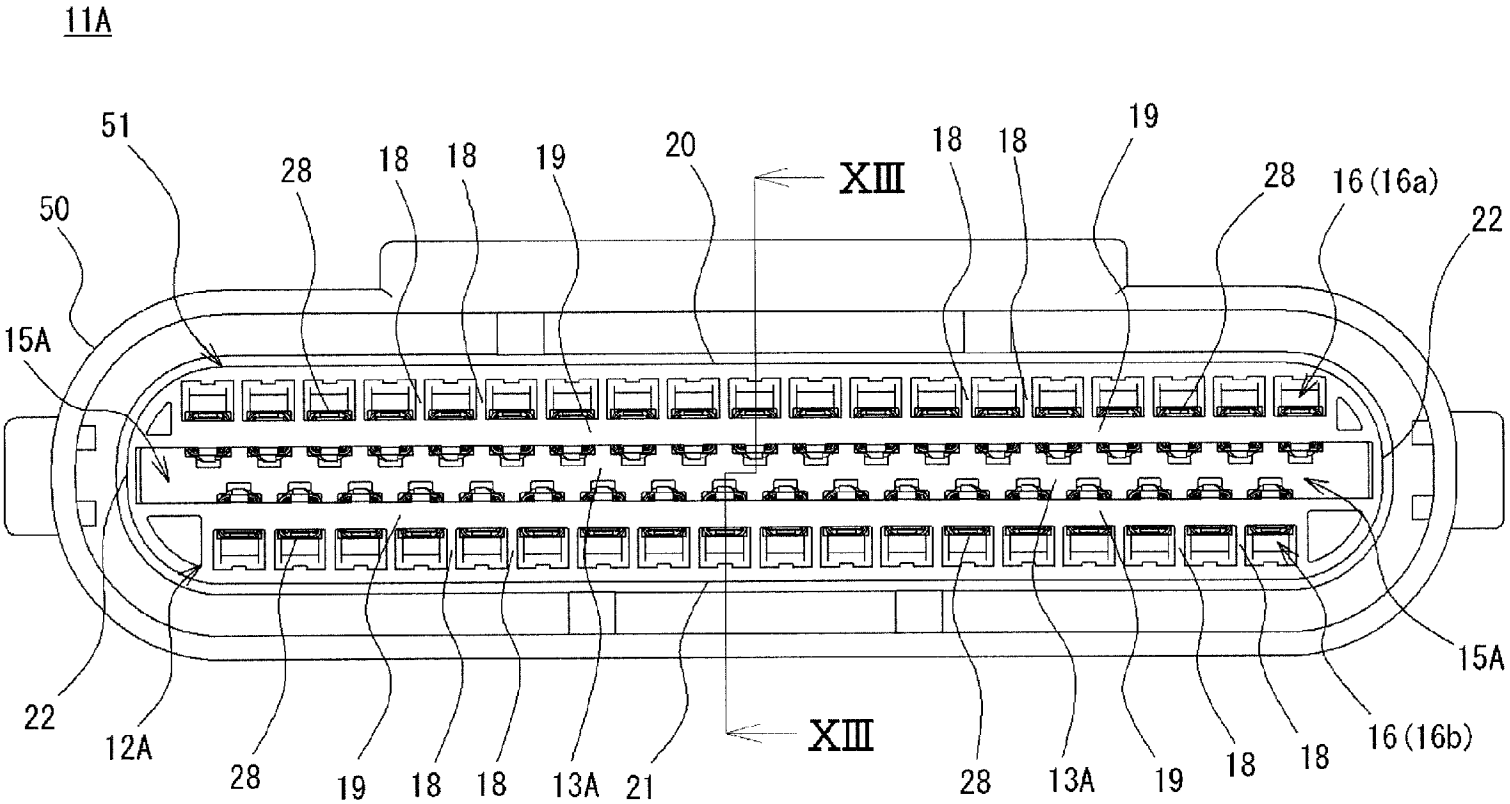
FIG. 12 is a front view of a female connector according to Embodiment 2.
Figure 13:
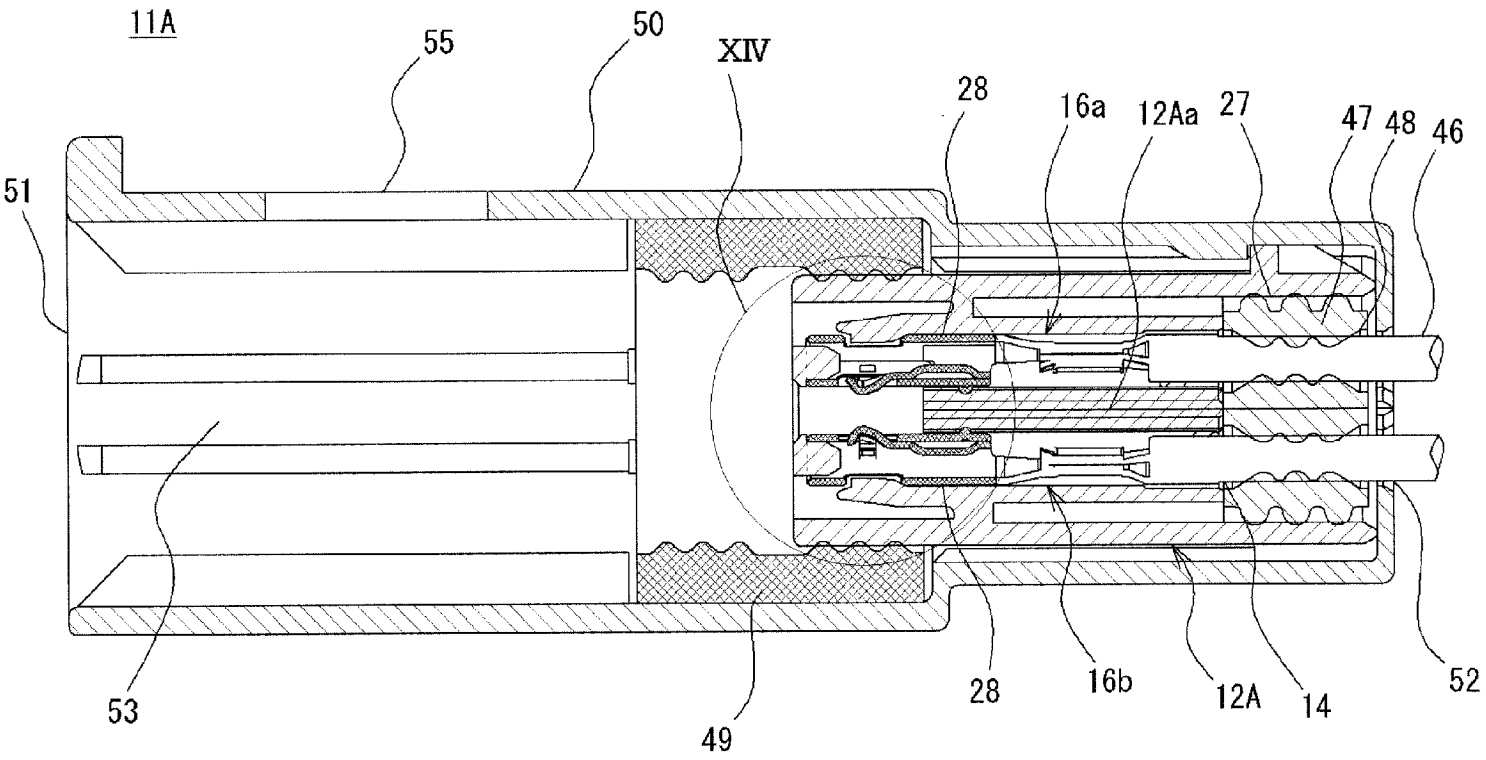
FIG. 13 is a sectional view taken along line XIII-XIII of FIG. 12.
Figure 14:
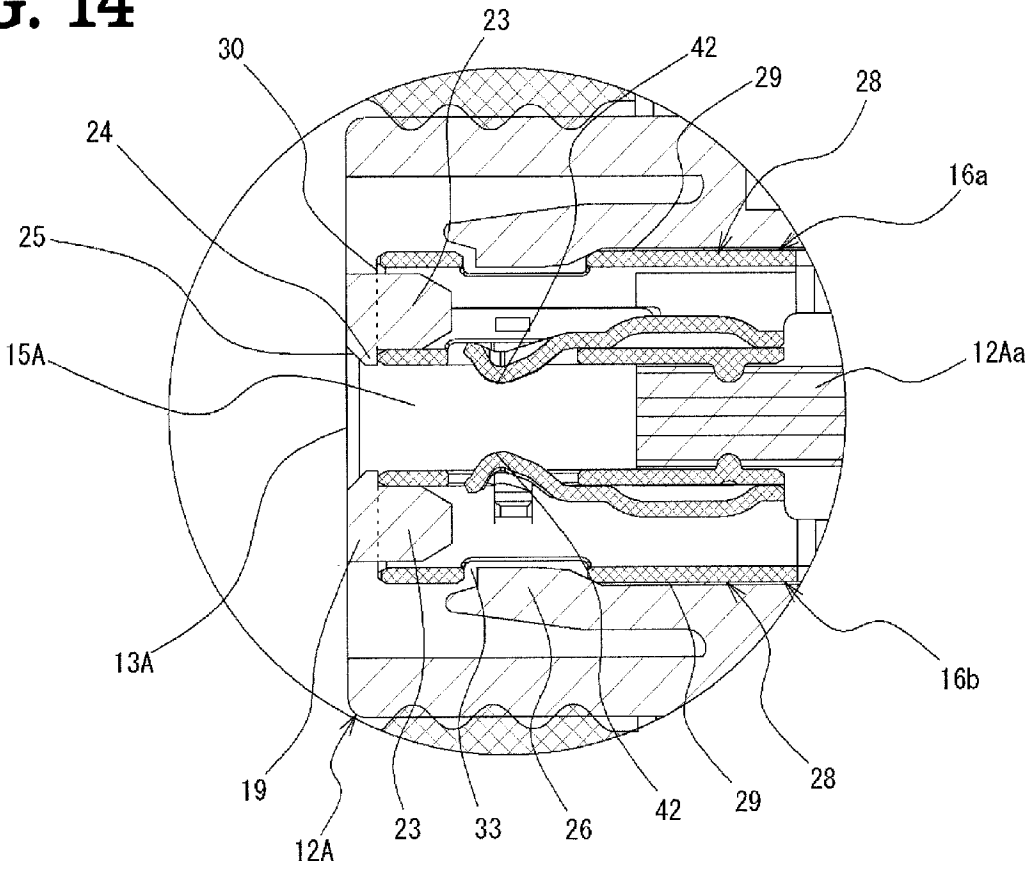
FIG. 14 is an enlarged sectional view of part XIV in FIG. 13.
Figure 15:
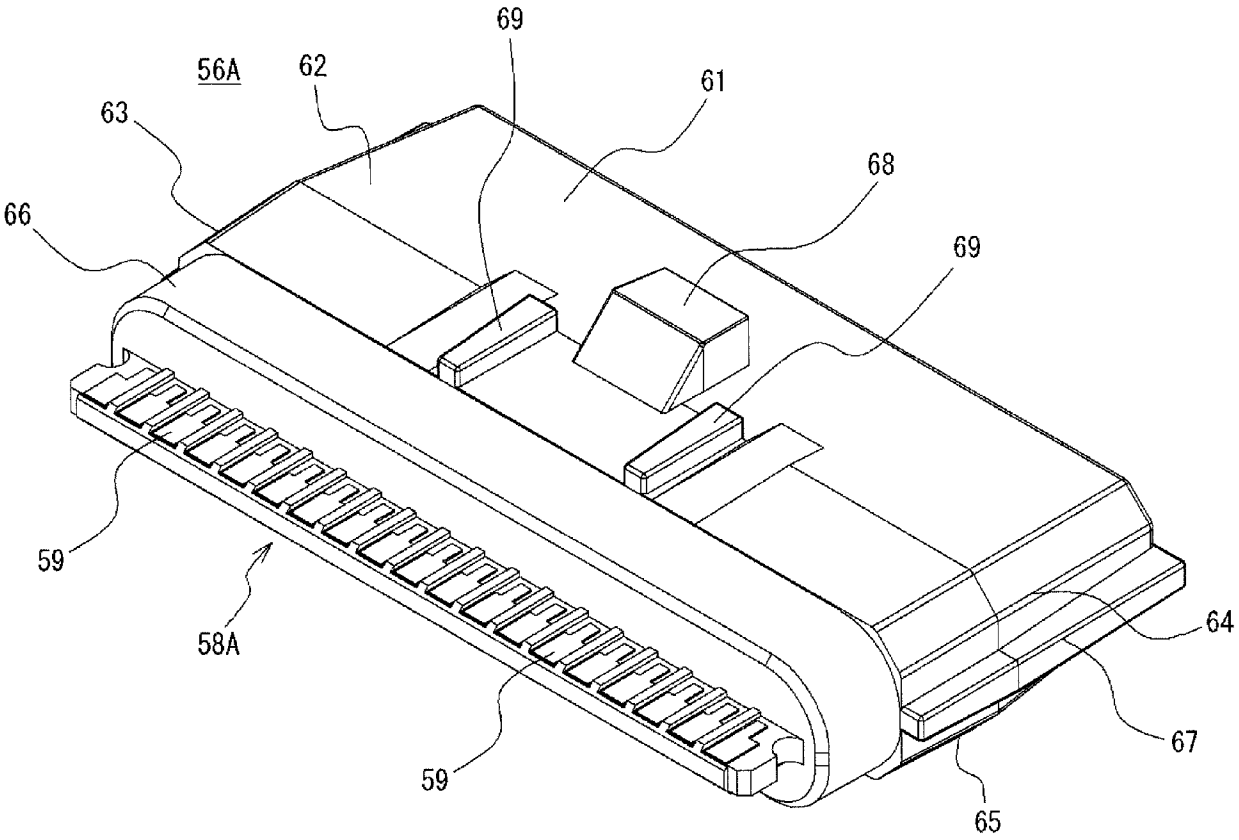
FIG. 15 is a perspective view of a card member according to Embodiment 2.

As illustrated in FIG. 12 to FIG. 14, the housing 12A includes a flat opening 13A on one side and an inserting part 14 on the other side. The flat opening 13A is formed to be wide in a width direction to which a card edge part 58A of the card member 56A is inserted and connected. Through the inserting part 14, a wire 46 is inserted. The housing 12A is provided inside with an interior space 15A communicating with the flat opening 13A. The housing 12A is a flat tubular body in which the contact accommodating parts 16 communicating with the inserting part 14 are provided at the upper side and the lower side opposed to each other with the interior space 15A and an internal structure 12Aa of the housing 12A interposed therebetween. The interior space 15A provided inside the housing 12A is a part where the card edge part 58A of the connected card member 56A is arranged, and the contact accommodating part 16 is a part where the contact 28 is positioned and fixed to be accommodated. A wire seal mounting part 27 to which the wire seal 47 is mounted is provided inside the housing 12A on the inserting part 14 side.

In the contact accommodating part 16, each of an upper contact accommodating part 16*a* (hereinafter, also simply referred to as an upper side 16*a*) and a lower contact accommodating part 16*b* (hereinafter, also simply referred to as a lower side 16*b*) opposed to each other with the interior space 15A and the internal structure 12Aa of the housing 12A interposed therebetween includes an accommodating space in which each of the contacts 28 is accommodated. The upper side 16*a* and the lower side 16*b* of the contact accommodating part 16 are alternately formed. The upper side 16*a* and the lower side 16*b* of the contact accommodating part 16 each have a side wall part 18 formed on the side surface side of the contact 28 to be accommodated, and an end wall part 19 formed on the flat opening 13A side of the housing 12A, so that the contact 28 is covered with the side wall part 18 and the end wall part 19.

The end wall part 19 of the contact accommodating part 16 is formed such that the upper side 16*a* and the lower side 16*b* opposed to each other with the flat opening 13A interposed therebetween are integrally connected. The end wall parts 19 of the upper side 16*a* and the lower side 16*b* are also connected to a side surface side 22 of the housing 12A. The side wall parts 18 of the upper side 16*a* and the lower side 16*b* lie opposite from the flat opening 13A and the interior space 15A side so as to be connected to a top surface side 20 and a bottom surface side 21 of the housing 12A, respectively. As described above, the end wall part 19 and the side wall part 18 of the contact accommodating part 16 are connected to and integrally formed with the side surface side 22, the top surface side 20, and the bottom surface side 21 of the housing 12A, thereby enhancing the strength of the contact accommodating part 16.

In the housing 12A of the Embodiment 2, the end wall part 19 includes a protruding part 23 having a particular length formed on the contact accommodating part 16 side so as to correspond to the accommodated contact 28. The protruding part 23 is formed to have a cylindrical shape or a prism shape, for example. In the contact accommodating part 16, the end wall part 19 of each of the upper side 16*a* and the lower side 16*b* has a convex part 24 for regulating insertion of the contact 28 when the contact 28 is inserted.

In the end wall part 19 of each of the upper side 16*a* and the lower side 16*b*, the convex part 24 has a taper 25 on the flat opening 13A side so that the card edge part 58A inserted of the card member 56A can be smoothly introduced into the interior space 15A. In this case, the convex part 24 of the end wall part 19 functions as a wall against the contact 28 placed on the side to which the card edge part 58A is inserted, thereby preventing a tip of the card edge part 58A from contacting an end of the contact 28 and preventing damage on the card edge part 58A.

In the upper side 16*a* and the lower side 16*b* of the contact accommodating part 16, the side to which the card edge part 58A is inserted is at least partially opened, so that the contact 28 accommodated can be connected to the card edge terminal 59. A locking protrusion 26 that is locked to the accommodated contact 28 is formed on the side opposite from the side where the contact accommodating part 16 is opened.

Next, the contact 28 will be described with reference to FIGS. 6 and 7, and FIGS. 13 and 14. The contact 28 is electrically connected to the card edge part 58A (refer to FIG. 16) of the card member 56A. The contact includes a connecting part 29 connected to the card edge terminal 59 on one side and a wire mounting part 44 to which the wire 46 is mounted on the other side, and a connecting part 29 and a wire mounting part 44 are integrally formed. The contact 28 is formed by, for example, pressing and folding a punched metal plate body.

The connecting part 29 has a first opening 30 formed on the flat opening 13A side when the contact 28 is accommodated in the contact accommodating part 16 and a second opening 31 formed on the wire mounting part 44 side. The connecting part 29 is formed in a hollow tubular shape including a bottom surface 32, one side surface 34, the other side surface 36, and a top surface 38, for example.

The bottom surface 32 included in the connecting part 29 is formed in a rectangular having a particular area. The bottom surface 32 has both ends, parallel to the axial direction of the bottom surface 32, bent at a right angle to form the one side surface 34 and the other side surface 36. The one side surface 34 has an end on the opposite side to the bottom surface 32 side bent at a right angle to form the top surface. The other side surface 36 has part of an edge on the second opening 31 side on the opposite side to the bottom surface 32 side bent at a right angle to form a contact segment 41 arranged below the top surface.

The other side surface 36 has a notch 37 formed by cutting out the other side surface 36 on the top surface 38 side at a part other than an extended part 43 in which the contact segment 41 lies in an upper part of the other side surface 36. The top surface 38 has a short side surface 39 having a size corresponding to the notch 37 and formed by bending the top surface 38 at a right angle at an edge on the other side surface 36 side. The notch 37 is closed by the short side surface 39. With such a structure, the connecting part 29 is formed in a hollow rectangular parallelepiped shape.

The contact segment 41 is formed of a curved plate body. The contact segment 41 includes a contacting part 42 contacting the card edge terminal 59 on one side, and is connected to the extended part 43 connected to the other side surface 36 is integrally provided on the other side. An aperture 40 is formed on the top surface 38, and the contacting part 42 provided on the contact segment 41 is arranged so that it protrudes from the aperture 40.

In this manner, at the connecting part 29, the contacting part 42 is pressed and moved by the card edge terminal 59 when the card member 56A is attached or detached and elastically deformed in a vertical direction with respect to the extended part 43, so that sufficient contact pressure can be obtained even if there is a strain at the card edge part.

The bottom surface 32 of the contact 28 has a locking hole 33 and can be locked to the locking protrusion 26 formed in the contact accommodating part 16 of the housing 12A. The contact 28 includes on the one side surface 34 side a regulation part 35 for regulating a movable range in which the contact segment 41 is pressed down by connection with the card member 56A. The regulation part 35 is formed by bending part of the one side surface 34. Forming the regulation part 35 leads to deformation of the contacting part 42 of the contact 28 within a certain range, thereby preventing reduction in the contact pressure between the card edge terminal 59 and the contact 28.

As illustrated in FIG. 6, piece parts 45 on both sides of the wire mounting part 44 is upwardly formed when the wire 46 is not mounted. When the wire 46 is mounted, the piece parts 45 on both sides are bent to hold the wire 46 therebetween, so that the contact 28 is mounted to the wire 46. One end of the wire 46 is mounted to the contact 28 and the other end thereof is connected to external electronic equipment and the like to exchange an electric signal between the card edge connector 10A and the external equipment.

As illustrated in FIG. 13, the wire seal 47 has a plurality of through holes 48 through which the wire 46 passes and is formed of an elastic member having a shape that enables the wire seal 47 to be mounted to the wire seal mounting part 27 of the housing 12A. The wire seal 47 fixes the wire 46 arranged in the housing 12A and prevents liquid and the like from entering from the side where the wire 46 is arranged.

As illustrated in FIG. 13, the sealing member 49 is arranged at the outer circumference of the housing 12A on the flat opening 13A side and is formed in a large tubular shape that protrudes from the end of the housing 12A. A card member 56A connected is fitted in the protruded inner side of the sealing member 49. Projections and depressions are annularly formed on the inner side of the sealing member 49.

Figures 11A, 11B, 11C, 11D, 11E, 11F:
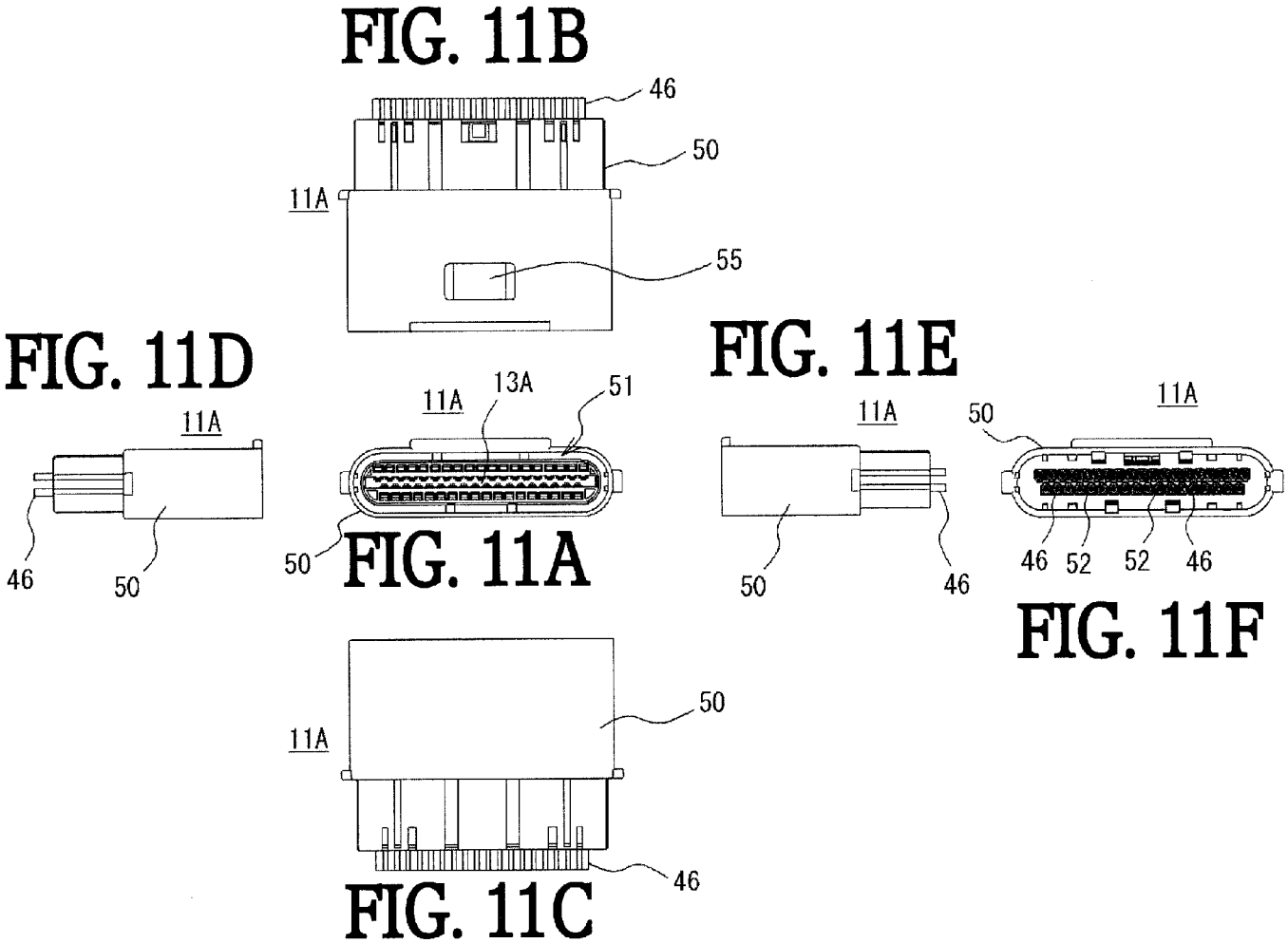
FIG. 11A is a front view of a female connector according to Embodiment 2.
FIG. 11B is a top view thereof.
FIG. 11C is a bottom view thereof.
FIG. 11D is a side view thereof viewed from one side.
FIG. 11E is a side view thereof viewed from the other side.
FIG. 11F is a back view thereof.

As illustrated in FIG. 11 and FIG. 13, the exterior covering member 50 is formed in a size to cover the housing 12A and the sealing member 49 attached to the housing, and the card member 56A connected to the housing 12A. The exterior covering member 50 is formed in a tubular shape having an insertion slot 51 to which the card member 56A on one side thereof and an insertion port 52 through which the wire 46 is inserted on the other side thereof. An upper part of the exterior covering member 50 is provided with a coupling hole 55 that is used when connected to the card member 56A. The exterior covering member 50 has inside an engaging groove 54 and a guide groove 53.

Next, assembly of the female connector 11A will be described with reference to FIG. 13 and FIG. 14. In assembling the female connector 11A, first, the wire 46 is mounted to the wire mounting part 44 of the contact 28. As described above, the wire 46 is fixed by bending the piece parts 45 on both sides of the wire mounting part 44 of the contact 28 to hold the wire 46 therebetween.

Next, the contact 28 with the wire 46 mounted is inserted into the insertion port 52 of the exterior covering member 50, so that the wire 46 is inserted through the exterior covering member 50 in advance. In this case, the contact 28 protrudes from the insertion port 52 of the exterior covering member 50, thereby facilitating subsequent assembly.

The contact 28 with the wire 46 mounted is then attached to the housing 12A. In this attachment, the wire seal 47 is mounted to the wire seal mounting part 27 of the housing 12A in advance, and the contact 28 is inserted along with the through hole 48 of the wire seal 47 from the inserting part 14 side of the housing 12A in which, so that the contact 28 is accommodated in the contact accommodating part 16. In this case, the contact 28 is inserted such that each of the contacting parts 42 of the connecting part 29 of the contact 28 faces the interior space 15A side of the housing 12A on the upper side and the lower side of the contact accommodating part 16.

The contact 28 is inserted such that the protruding part 23 formed at the end wall part 19 of the housing 12A is fitted in the first opening 30 of the contact 28 and the locking protrusion 26 of the contact accommodating part 16 is locked to the locking hole 33 of the contact 28 (refer to FIG. 14). The contact 28 is thus fitted in the protruding part 23 of the end wall part 19 of the contact accommodating part 16, so that the contact 28 is firmly fixed to the contact accommodating part 16. This can prevent loss of the contact pressure when the contact 28 is connected to the card member 56A.

The sealing member 49 is then attached to the housing 12A, and the housing 12A is arranged inside the exterior covering member 50, so that the assembly of the female connector 11A is completed.

Next, connection of the card member 56A to the female connector 11A will be described. The card member 56A according to Embodiment 2 will be described first with reference to FIG. 15. The card member 56A includes: a substrate 57A on which circuit wiring and the like are printed and a plurality of card edge terminals 59 to contact with the contact 28 included in the female connector 11A are formed on one end thereof; and a resin molded part 61 integrally molded with a synthetic resin material so that the card edge part of the substrate 57A protrudes.

The substrate 57A (refer to FIG. 16) has a printed circuit or an integrated circuit, for example, mounted on the front side or back side thereof. The substrate 57A includes, at the end thereof, the card edge part 58A in which a plurality of card edge terminals 59 to contact with and electrically connected with the contact 28 of the female connector 11A. The card edge terminals 59 are formed of an electrical conducting material conducted with the circuit wiring and the like formed on the substrate 57A and are arranged at particular intervals so as to be alternate on the front side and the back side.

The resin molded part 61 is formed in a low-profile rectangular parallelepiped shape so as to enclose the substrate 57A. The top surface 62 and the bottom surface 65 of the resin molded part 61 have engaging protrusions 69 used for guiding or positioning when the resin molded part 61 is connected to the female connector 11A. Both side surfaces 63 and 64 of the resin molded part 61 have guide protrusions 67. The top surface 62 of the resin molded part 61 has a lock part 68 coupled to the female connector 11A substantially at the center thereof.

Figure 16A:
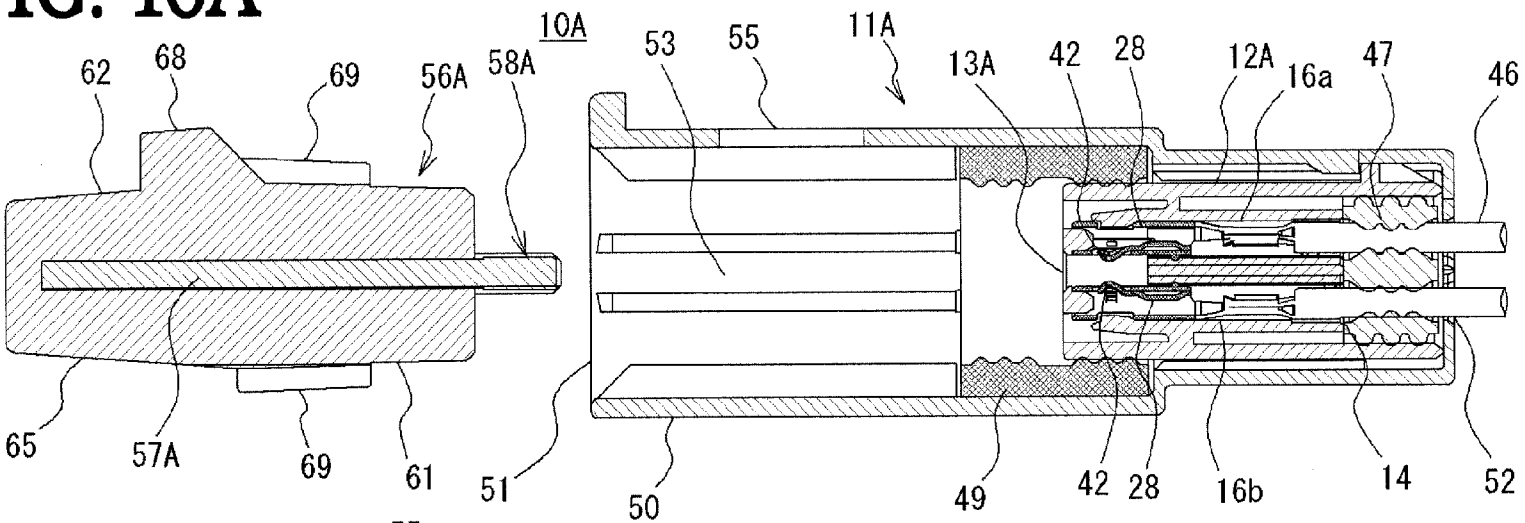
FIG. 16A and FIG. 16B are sectional views illustrating a connecting process of the card edge connector.
Figure 16B:
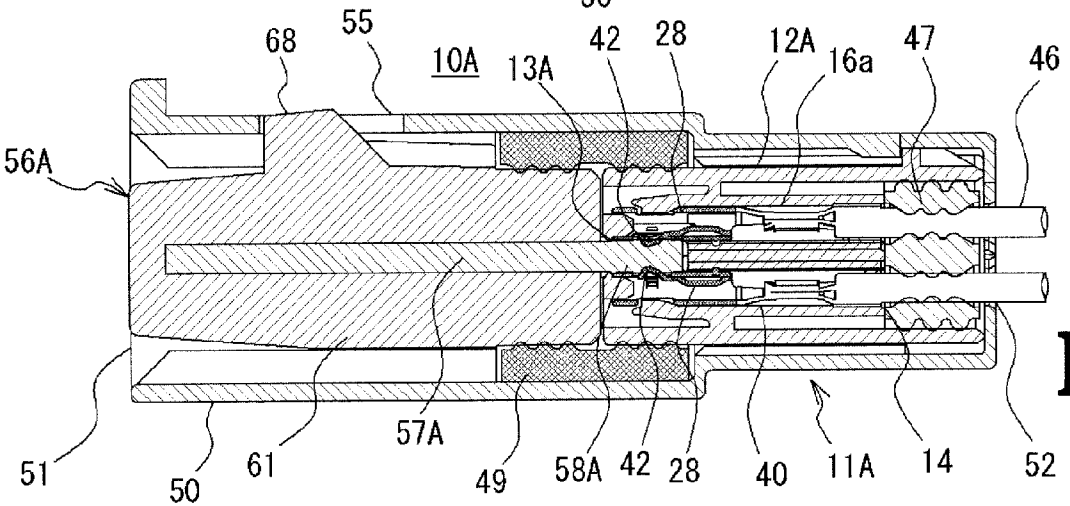

The resin molded part 61 has an annular engaging part 66 at a part connected to the female connector 11A on the side where the card edge part 58A protrudes. As illustrated in FIG. 16, the engaging part 66 is formed at the outer circumference of the resin molded part 61 where the card edge part 58A protrudes, and is engaged with the sealing member 49 provided in the female connector 11A when the card member 56A is connected to the female connector 11A.

Next, connection of the card member 56A to the female connector 11A will be described with reference to FIG. 16. To connect the female connector 11A with the card member 56A, first, the card member 56A is inserted into the insertion slot 51 of the exterior covering member 50 with the card edge part 58A of the card member 56A being in the lead. In this case, the positions of the engaging groove 54 and the guide groove 53 of the exterior covering member 50 and the engaging protrusion 69 and the guide protrusion 67 of the card member 56A are aligned, respectively, for the insertion.

Subsequently, the insertion is continued to connect the connecting part 29 of the contact 28 to the card edge terminal 59, the coupling hole 55 of the exterior covering member 50 is coupled to the lock part 68 of the card member 56A, and the sealing member 49 provided in the female connector 11A is engaged with the engaging part 66 of the card member 56A to complete the connection.

In Embodiment 1, the rib 17 is provided in the housing 12, thereby preventing the flat opening 13 and the interior space 15 communicating therewith from opening at a high temperature. In addition, the protruding part 23 formed on the housing 12 is fitted in the contact 28, thereby preventing loss of the contact pressure. However, some card edge connectors have a narrow substrate of the card member. If the substrate is narrow, there may be no space in which the slit to be fitted with the rib is formed. Even in such a case, with the card edge connector 10A of Embodiment 2, the end wall part 19 including the protruding part 23 formed thereon to which the contact 28 is fitted is integrally formed with the housing 12A in the contact accommodating part 16 for accommodating the contact 28, thereby firmly fixing the contact 28 to the contact accommodating part 16 and preventing the loss of the contact pressure. A narrow card edge connector can lead to a structure of the female connector that can almost prevent the flat opening and the like from opening due to a high temperature, thereby eliminating the rib as in Embodiment 1.

The card member 56A is covered with the exterior covering member 50 provided to the female connector 11A, thereby preventing the card member 56A from being damaged due to a collision or the like. The exterior covering member 50 of the female connector 11A formed so as to cover the card member 56A causes the guide protrusion 67 formed on the card member 56A to be guided by the guide groove 53 formed in the exterior covering member 50 of the female connector 11A, thereby securely performing the connection.

The guide protrusion 67 is formed at the part other than the engaging part on the side surface of the card member 56A, and the guide protrusion 67 is engaged with the guide groove 53 of the exterior covering member 50 of the female connector 11A. Therefore, the card member 56A vibrates together with the card edge connector 10A, which can prevent the card member 56A from vibrating independently. This can prevent load on the card edge terminal 59 connected between the card member 56A and the female connector 11A.

The invention claimed is:

1. A female connector connected to a card member including a card edge part in which at least one card edge terminal is formed on at least one surface, the female connector comprising:

at least one contact including a connecting part connected to the card edge terminal on one side and a wire mounting part to which a wire is mounted on the other side, the connecting part and the wire mounting part being integrally formed;

a housing having a flat opening to which the card edge part is inserted on one side and an inserting part through which the wire is inserted on the other side, the housing having inside an interior space communicating with the flat opening and accommodating the card edge part, and contact accommodating parts oppositely provided with the interior space interposed therebetween and accommodating the contact positioned and fixed therein, and the interior space of the housing having on at least one spot a rib connecting an upper side of the contact accommodating part and a lower side of the contact accommodating part with the flat opening of the contact accommodating part interposed therebetween the upper side of the contact accommodating part and the lower side of the contact accommodating part; and an end wall part formed on a first opening side of the connecting part of the contact, the first opening being formed on the flat opening side of the housing, the end wall part including a protruding part fitted in the first opening of the connecting part on the side opposed to the contact.

2. The female connector according to claim 1, wherein the connecting part of the contact has the first opening formed on the flat opening side of the housing and a second opening formed on the side in which the wire mounting part is provided, and is formed in a hollow tubular shape including a contacting part contacting the card edge terminal, the contact accommodating part of the housing has a side wall part formed on the side surface sides of the accommodated contact and the end wall part formed on the first opening side to cover the contact, and has an opened part accommodating at least the contacting part of the contact.

3. The female connector according to claim 2, wherein the end wall part formed at the housing is integrally and continuously formed on one side and the other side with the flat opening interposed therebetween.

4. The female connector according to claim 2, wherein the connecting part is formed in a hollow rectangular parallelepiped shape having:

a rectangular bottom surface having a particular area;

one side surface and the other side surface formed by bending the bottom surface at a right angle at both edges thereof parallel to an axial direction;

a top surface formed by bending the one side surface at a right angle at an edge thereof opposite to the bottom surface; and a contact segment arranged below the top surface and formed by bending the other side surface at a right angle at part of an edge thereof on the second opening side on the opposite side to the bottom surface, the other side surface has a notch formed by cutting out the other side surface on the top surface side at a part other than an extended part in which the contact segment lies, the notch is closed by a short side surface having a size corresponding to the notch and formed by bending the top surface on the other side surface side at a right angle at an edge thereof, the contact segment is formed of a curved plate body, includes the contacting part contacting the card edge terminal on one side, is connected to the extended part of the other side surface on the other side, and is arranged so as to have the contacting part protruded from an aperture formed on the top surface, and the contacting part is pressed and moved by attachment/detachment of the card member and is elastically deformed in a vertical direction with respect to the extended part.

5. The female connector according to claim 4, wherein the bottom surface of the contact has an opened locking hole, the contact accommodating part has a locking protrusion locked to the locking hole on the side where the bottom surface of the contact is arranged when the contact is accommodated therein, and the locking hole is locked to the locking protrusion when the contact is accommodated in the contact accommodating part.

6. The female connector according to claim 4, wherein the one side surface or the other side surface of the contact includes a regulation part for regulating a movable range in which the contact segment is pressed down.

7. The female connector according to claim 1, wherein the housing is provided with an annular sealing member formed of an elastic material at an outer circumference thereof on the side to which the card member is connected, and the sealing member is formed to have a size to be sealed with part of the card member when the card member is connected to the housing.

8. The female connector according to claim 7, wherein the outer side of the housing and the sealing member is mounted with a hollow exterior covering member having an insertion slot to which the card member is inserted on one side and an insertion port through which the wire is inserted on the other side, and the exterior covering member is formed in a size to cover the card member connected.

9. The female connector according to claim 8, wherein the exterior covering member has a guide groove to which a guide protrusion formed on the card member is guided and fitted.

10. The female connector according to claim 8, wherein the exterior covering member includes a coupling part coupled to a lock part formed in the card member.

11. A female connector connected to a card member including a card edge part in which at least one card edge terminal is formed on at least one surface, the female connector comprising:

at least one contact including a connecting part connected to the card edge terminal on one side and a wire mounting part to which a wire is mounted on the other side, the connecting part and the wire mounting part being integrally formed; and a housing having a flat opening to which the card edge part is inserted on one side and an inserting part through which the wire is inserted on the other side, the housing having inside an interior space communicating with the flat opening and accommodating the card edge part, and contact accommodating parts oppositely provided with the interior space interposed therebetween and accommodating the contact positioned and fixed therein, the connecting part of the contact having a first opening formed on the flat opening side of the housing and a second opening formed on the side in which the wire mounting part is provided, and formed in a hollow tubular shape including a contacting part contacting the card edge terminal, the contact accommodating part of the housing having a side wall part formed on the side surface sides of the accommodated contact and an end wall part formed on the first opening side to cover the contact, and having an opened part accommodating at least the contacting part of the contact, and the end wall part including a protruding part fitted in the first opening of the connecting part on the side opposed to the contact.

12. The female connector according to claim 11, wherein the end wall part formed at the housing is integrally and continuously formed on one side and the other side with the flat opening interposed therebetween.

13. The female connector according to claim 11, wherein the connecting part is formed in a hollow rectangular parallelepiped shape having:

a rectangular bottom surface having a particular area;

one side surface and the other side surface formed by bending the bottom surface at a right angle at both edges thereof parallel to an axial direction;

a top surface formed by bending the one side surface at a right angle at an edge thereof opposite to the bottom surface; and a contact segment arranged below the top surface and formed by bending the other side surface at a right angle at part of an edge thereof on the second opening side on the opposite side to the bottom surface, the other side surface has a notch formed by cutting out the other side surface on the top surface side at a part other than an extended part in which the contact segment lies, the notch is closed by a short side surface having a size corresponding to the notch and formed by bending the top surface on the other side surface side at a right angle at an edge thereof, the contact segment is formed of a curved plate body, includes the contacting part contacting the card edge terminal on one side, is connected to the extended part of the other side surface on the other side, and is arranged so as to have the contacting part protruded from an aperture formed on the top surface, and the contacting part is pressed and moved by attachment/detachment of the card member and is elastically deformed in a vertical direction with respect to the extended part.

14. The female connector according to claim 13, wherein the bottom surface of the contact has an opened locking hole, the contact accommodating part has a locking protrusion locked to the locking hole on the side where the bottom surface of the contact is arranged when the contact is accommodated therein, and the locking hole is locked to the locking protrusion when the contact is accommodated in the contact accommodating part.

15. The female connector according to claim 13, wherein the one side surface or the other side surface of the contact includes a regulation part for regulating a movable range in which the contact segment is pressed down.

16. The female connector according to claim 11, wherein the housing is provided with an annular sealing member formed of an elastic material at an outer circumference thereof on the side to which the card member is connected, and the sealing member is formed to have a size to be sealed with part of the card member when the card member is connected to the housing.

17. The female connector according to claim 16, wherein the outer side of the housing and the sealing member is mounted with a hollow exterior covering member having an insertion slot to which the card member is inserted on one side and an insertion port through which the wire is inserted on the other side, and the exterior covering member is formed in a size to cover the card member connected.

18. The female connector according to claim 17, wherein the exterior covering member includes:

a guide groove to which a guide protrusion formed on the card member is guided and fitted; and a coupling part coupled to a lock part formed in the card member.

19. A card edge connector comprising:

a card member including a card edge part in which at least one card edge terminal is formed on at least one surface; and a female connector connected to the card member, wherein the card member having a slit formed at the card edge part, the female connector includes:

at least one contact including a connecting part connected to the card edge terminal on one side and a wire mounting part to which a wire is mounted on the other side, the connecting part and the wire mounting part being integrally formed;

a housing having a flat opening to which the card edge part is inserted on one side and an inserting part through which the wire is inserted on the other side, the housing having inside an interior space communicating with the flat opening and accommodating the card edge part, and contact accommodating parts oppositely provided with the interior space interposed therebetween and accommodating the contact positioned and fixed therein, and the interior space of the housing having on at least one spot corresponding to the slit of the card member a rib connecting an upper side of the contact accommodating part and a lower side of the contact accommodating part with the flat opening of the contact accommodating part interposed therebetween the upper side of the contact accommodating part and the lower side of the contact accommodating part; and an end wall part formed on a first opening side of the connecting part of the contact, the first opening being formed on the flat opening side of the housing, the end wall part including a protruding part fitted in the first opening of the connecting part on the side opposed to the contact.

20. A card edge connector comprising:

the female connector; and the card member connected to the female connector and including a card edge part in which at least one card edge terminal is formed on at least one surface, wherein the female connector includes:

at least one contact including a connecting part connected to the card edge terminal on one side and a wire mounting part to which a wire is mounted on the other side, the connecting part and the wire mounting part being integrally formed; and a housing having a flat opening to which the card edge part is inserted on one side and an inserting part through which the wire is inserted on the other side, the housing having inside an interior space communicating with the flat opening and accommodating the card edge part, and contact accommodating parts oppositely provided with the interior space interposed therebetween and accommodating the contact positioned and fixed therein, the connecting part of the contact has a first opening formed on the flat opening side of the housing and a second opening formed on the side in which the wire mounting part is provided, and is formed in a hollow tubular shape including a contacting part contacting the card edge terminal, the contact accommodating part of the housing has a side wall part formed on the side surface sides of the accommodated contact and an end wall part formed on the first opening side to cover the contact, and has an opened part accommodating at least the contacting part of the contact, and the end wall part includes a protruding part fitted in the first opening of the connecting part on the side opposed to the contact.

* * * * *